US006305856B1

(12) United States Patent
Miyazaki

(10) Patent No.: US 6,305,856 B1
(45) Date of Patent: Oct. 23, 2001

(54) PRINTING METHOD AND APPARATUS THEREFOR

(75) Inventor: Takao Miyazaki, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/571,548

(22) Filed: May 16, 2000

(30) Foreign Application Priority Data

May 19, 1999 (JP) ..... 11-139208
Apr. 12, 2000 (JP) ..... 12-111204

(51) Int. Cl.[7] ..... B41J 21/46
(52) U.S. Cl. ..... 400/279; 400/120.01
(58) Field of Search ..... 400/279, 120.01

(56) References Cited

U.S. PATENT DOCUMENTS 5,127,752 * 7/1992 Courtney ..... 400/342
5,255,987 * 10/1993 Mizuno et al. ..... 400/61
6,053,645 * 4/2000 Myung ..... 400/64

FOREIGN PATENT DOCUMENTS

06032009 A 2/1994 (JP) ..... B41J/19/18
10044482 A 2/1998 (JP) ..... B41J/2/325

OTHER PUBLICATIONS

Patent Abstract of Japan 10044482 Feb. 17, 1998.
Patent Abstract of Japan 06032009 Feb. 8, 1994.

* cited by examiner

*Primary Examiner*—John S. Hilten
*Assistant Examiner*—Charles H. Nolan, Jr.
(74) *Attorney, Agent, or Firm*—Sughrue, Mion, Zinn, Macpeak & Seas, PLLC

(57) ABSTRACT

There is disclosed a method and an apparatus of printing an image in a rectangular recording area on a recording material by a printing head as the recording material is advanced in a sub scan direction perpendicular to a main scan direction of the printing head. The printing head has a wider main scanning range than a width of the recording area. On side edge of the advancing recording medium is detected at two points to determine positions in the main scan direction of the two side edge points. Based on the positions of the side edge points, an inclination of the recording medium to the sub scan direction as well as positions of four corner points of the recording area in the main and sub scan direction relative to a center point of the main scanning range are determined. Based on the relative positions of the four corner points, a sub scanning range of the printing head that corresponds to a length of the recording material to be advanced for recording one image is determined, such that a scanning area defined by the main and sub scanning ranges covers the recording area. Then, print data is produced from image data of an image to print and blank data, such that the print data corresponds in size to the scanning area and includes the image data in a location corresponding to a location of the recording area within the scanning area. The blank data is allocated to other locations of the print data so no pixel is recorded outside the recording area.

19 Claims, 16 Drawing Sheets

PRINTING METHOD AND APPARATUS THEREFOR

BACKGROUND OF THE INVENTION

1. Field of the Invention

The present invention relates to a method and an apparatus for printing an image on an advancing recording medium while adjusting printing position of the image to position of the advancing recording medium relative to a printing head.

2. Background Arts

There have been various kinds of line printers which record images on advancing recording medium by using a linear printing head that extends in a main scan direction transverse to the advancing direction of the color thermosensitive recording medium. In thermal type line printers, the printing head is provided with an array of heating elements. In optical type line printers, the printing head is provided with an array of light emitting elements.

In either type, it is required to position the individual images properly on the recording medium. That is, the image should be printed with predetermined margins or with no margin on the recording medium. By controlling position to start and stop printing the image on the recording medium or positions to cut the recording medium after the printing, it is possible to omit end margins before and behind the image in the paper advancing direction, or to provide the end margins with predetermined widths.

As for lateral sides of the image in the paper advancing direction, margins may be omitted by setting a maximum length of a main scanning line provided by the linear printing head to be equal to the width of the recording medium. By adjusting the length of the main scanning line, it is also possible to provide side margins of predetermined widths on the opposite lateral sides of the image. However, for many reasons, the advancing recording medium can be shifted in the main scan direction relative to the printing head or the main scanning line thereof. The recording medium can also inclines relative to a sub scan direction perpendicular to the main scan direction. Then the side margins would not have the predetermined widths, or the printed image would be inclined to the side edges of the recording medium. Where the image is intended to be printed without margins, undesirable blanks would be provided on the periphery of the image, or the printed image lacks some marginal portion. Therefore, it has been necessary to correct the position of the recording medium in the main scan direction frequently by adjusting paper guide members or the like.

A thermal printer disclosed in JPA 10-44482 suggests using a thermal head with a heating element array whose length is longer than a maximum width of the color thermosensitive recording paper. By shifting those heating elements which are used for recording among the array of the heating elements, the line provided by the thermal head is adjusted in length and position in the main scan direction to the width of the recording paper and the relative position of the recording paper to the thermal head. To print an image without the side margins, this prior art also suggest adding pixel data to original image data, thereby to print additional pixels on the fringe of the original image in accordance with the shifted amount of the color thermosensitive recording paper in the main scan direction. The additional pixels may have the same graduation value as the adjacent marginal pixel of the original image, or decreasing graduation values.

However, the thermal printer of this prior art does not have a device for detecting the shift amount of the color thermosensitive recording paper in the main scan direction. Therefore, it is necessary to preliminary print a test image in order to check the position of the test image as well as the marginal conditions, and then adjust paper guide members so as to optimize the marginal conditions. Especially when the advancing recording paper is not perpendicular to the main scan direction, it is impossible to eliminate undesirable blanks perfectly.

Furthermore, in the second method of the prior art, some of those heating elements which are driven with the original image data can be displaced from the color thermosensitive recording paper. In that case, the printed image would lack some marginal part of the original, and also heat energy is not transmitted from these heating elements to the ink sheet or the color thermosensitive recording paper, so the heat energy is accumulated and over-heats these heating elements.

JPA 6-32009 discloses a serial printer, wherein a photoelectric sensor is mounted to a serial printing head that scans the recording paper in the main scan direction. Before starting printing, the serial printing head moves in the main scan direction, so the photoelectric sensor detects opposite side edges of the recording paper. Thus, image printing position by the serial printing head is adjusted to the positions of the side edges in the main scan direction.

According to this prior method, it is easy to print an image without any margins even when the recording paper is shifted in the main scan direction. However, since the position of the recording paper in the main scan direction is detected once prior to starting printing, if the recording paper is not advanced in the perpendicular direction to the main scan direction during the printing, the printed image would be inclined to the side edges of the recording paper.

SUMMARY OF THE INVENTION

In view of the foregoing, an object of the present invention is to provide a method of printing an image in a recording area on a recording medium as the recording medium is advanced in a sub scan direction perpendicular to a main scan direction of a printing head, and an apparatus therefor, whereby the image is printed properly on the recording medium without the need for adjusting paper guide members or the like even while the recording medium is shifted in the main scan direction relative to the printing head, or is inclined to the perpendicular direction to the main scan direction.

Another object of the present invention is to provide a printing apparatus with a thermal head, which does not drive heating elements uselessly even when the image is to be printed without margins across the whole width of the recording paper.

To achieve the above object, the present invention provide a method that comprises the following steps on the assumption that the printing head may cover a wider main scanning range than the recording area:

A. detecting the advancing recording medium at least at two points on one side edge thereof to determine positions of the side edge points in the main scan direction;

B. calculating based on the positions of the side edge points a position of the recording area relative to the main scanning range of the printing head;

C. defining a scanning area of the printing head by the main scanning range and a sub scanning range in accordance with the relative position and dimensions of the recording area, such that the scanning area includes the recording area;

D. producing print data in a size corresponding to the scanning area from image data of an image to print, such that the print data includes the image data in a location corresponding to a location of the recording area within the scanning area; and E. driving the printing head with the print data while advancing the recording medium through the sub scanning range.

Since the side edge of the advancing recording medium is detected at least at two points, and the positions of the side edge points are determined relative to the main scanning range, it is possible to determine a position of the recording area in the main scan direction as well as an inclination of the recording area relative to the sub scan direction.

Since the scanning area of the printing head that is defined by the main scanning range and the sub scanning range is determined in accordance with the relative position and the dimensions of the recording area, and the printing head is driven with the print data that includes the image data in the location corresponding to the location of the recording area relative to the scanning area, the image is recorded properly in the recording area even while the advancing recording medium and thus the recording area are shifted in the main scan direction from a center of the main scanning range, or inclined to the sub scan direction.

According to the present invention, an apparatus of printing an image in a recording area on a photographic recording medium by a printing head that records pixels linearly on the recording medium along a main scan direction, as the recording medium is advanced in a sub scan direction perpendicular to the main scan direction comprises the following elements, wherein the printing head may record pixels across a main scanning range that is wider than a maximum length of the recording area in the main scan direction:

a detection device for detecting the advancing recording medium at least at two points on one side edge thereof to determine positions of the side edge points in the main scan direction;

a calculation device for calculating a relative position of the recording area to the main scanning range of the printing head based on the positions of the side edge points, and defining a scanning area of the printing head by the main scanning range and a sub scanning range, in accordance with the relative position and dimensions of the recording area, such that the scanning area includes the recording area;

a print data producing device for producing print data in a size corresponding to the scanning area from image data of an image to print, such that the print data includes the image data in a location corresponding to a location of the recording area within the scanning area; and a head driving device for driving the printing head with the print data while the recording medium is advanced through the sub scanning range.

According to a preferred embodiment, the detection device comprises a photoelectric sensor that extends linearly in the main scan direction in opposition to the one side edge of the advancing recording material.

According to another embodiment, the detection device comprises a photoelectric sensor that is movable in the main scan direction in a range crossing over the one side edge of the advancing recording material.

In a thermal line printer having a linear thermal head, the present invention provides a device for calculating a relative position of the recording area to the heating element array based on the positions of the side edge points and estimating, based on the calculated relative position of the recording area, which of the heating elements will face the recording area while the recording area is moving past the printing head; and a print data producing device for producing print data from image data of an image to print and blank data that does not cause the heating element to record a pixel, the print data producing device allocating the image data to those heating elements which face the recording area, and allocating the blank data to those heating elements which do not face the recording area.

By driving the thermal head with this print data, only those heating elements which face the recording area record pixels of the image, while those heating elements which do not face the recording area do not record any pixels, so that the image is recorded in the recording area.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
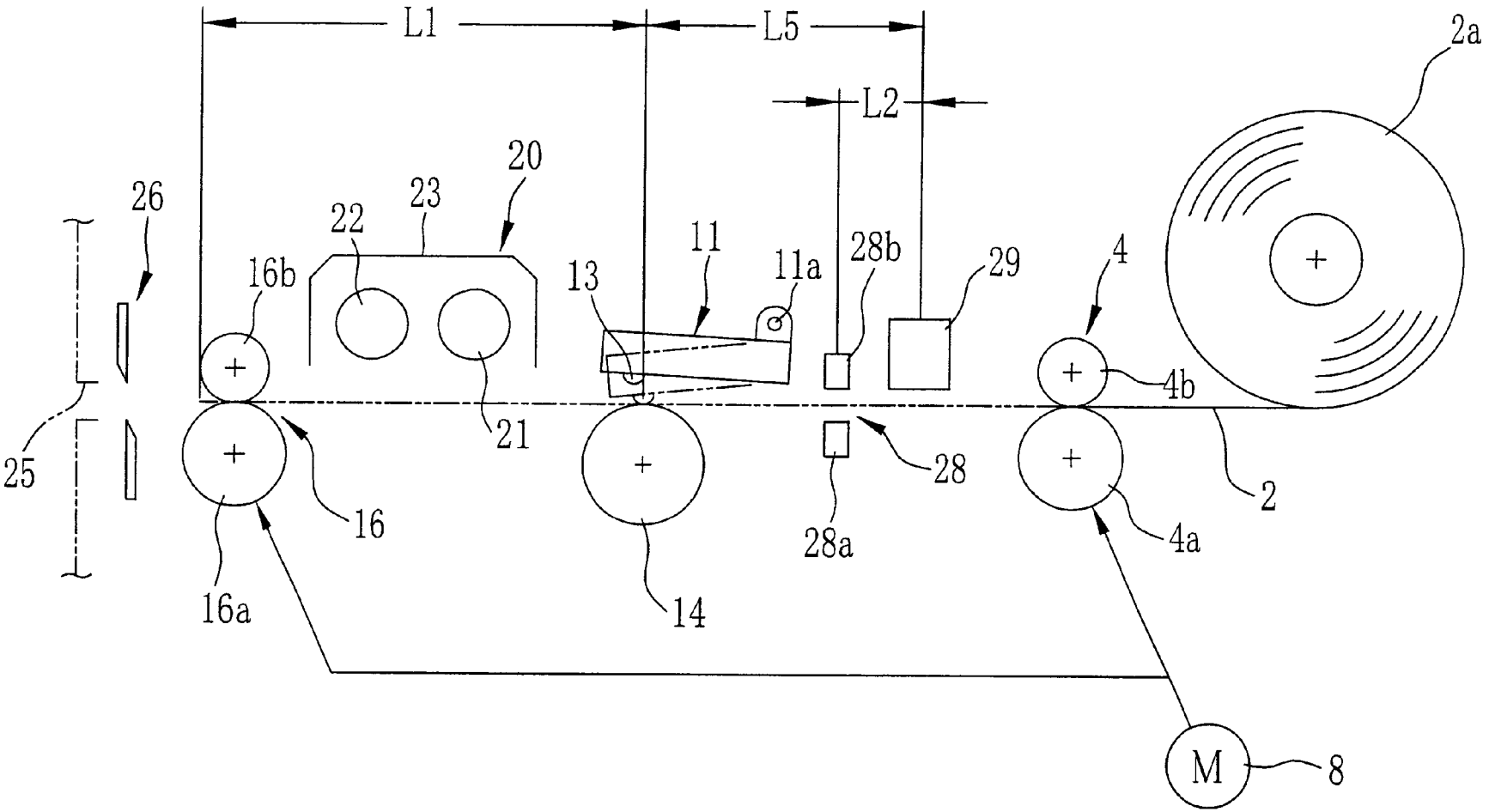
FIG. 1 is a schematic diagram of a color thermosensitive printer in an initial position according to an embodiment of the present invention.

A color thermosensitive printer shown in FIG. 1 uses a long web of color thermosensitive recording paper 2 that is loaded in the color thermosensitive printer in the form of a paper roll 2*a*. A leading end of the color thermosensitive recording paper 2 is withdrawn from the paper roll 2*a* and is squeezed into a paper feed roller pair 4 consisting of a capstan roller 4*a* driven by a pulse motor 8 and a pinch roller 4*b*. The paper feed roller pair 4 nips the leading end of the color thermosensitive recording paper 2 and feeds it to a thermal head 11.

The color thermosensitive recording paper 2 has cyan, magenta and yellow thermosensitive coloring layers formed on a base in this order toward an obverse. The outermost yellow thermosensitive coloring layer has the highest thermal sensitivity, so it requires the smallest heat energy for coloring, whereas the innermost cyan thermosensitive coloring layer has the lowest thermal sensitivity, so it requires the largest heat energy for coloring. The yellow thermosensitive coloring layer loses its coloring capability when exposed to near-ultraviolet rays of 420 nm, whereas the magenta thermosensitive coloring layer loses its coloring capability when exposed to ultraviolet rays of 365 nm. The color thermosensitive recording paper 2 may also include a thermosensitive coloring layer for black.

The thermal head 11 has a heating element array 13 consisting of a large number of heating elements arranged in a line, while the color thermosensitive recording paper 2 is being fed to the thermal head 11 along a path that extends orthogonal to the heating element array 13. The direction of the line of the heating element array 13 will be called a main scan direction, whereas the orthogonal direction to the main scan direction will be called a sub scan direction.

A platen roller 14 is disposed across the paper conveying path from the heating element array 13. The thermal head 11 is pivotal about an axis 11a between a retracted position away from the color thermosensitive recording paper 2 and a recording position pressing the color thermosensitive recording paper 2 onto the platen roller 14 as shown by phantom line in FIG. 1. In the recording position, the thermal head 11 heats the heating elements of the array 13 up to different temperatures to color the thermosensitive coloring layers of the color thermosensitive recording paper 2 selectively, as the color thermosensitive recording paper 2 is conveyed in the paper feeding direction.

An optical fixing device 20 is disposed behind the thermal head 11 in the paper feeding direction. The optical fixing device 20 consists of an yellow fixing lamp 21 emitting near-ultraviolet rays having a peak wavelength of 420 nm, a magenta fixing lamp 22 emitting ultraviolet rays having a peak wavelength of 365 nm, and a reflector 23. The yellow and magenta fixing lamps 21 and 22 are used for fixing the yellow and magenta thermosensitive coloring layers respectively after they are colored by the thermal head 11.

A paper conveyer roller pair 16 is disposed behind the thermal head 11 in the paper feeding direction. The paper conveying roller pair 16 consists of a capstan roller 16*a* and a pinch roller 16, and the capstan roller 16*a* is driven by the motor 8. The color thermosensitive recording paper 2 is conveyed back and forth along the paper path through the paper feed roller pair 4 and the paper conveyer roller pair 16. While the color thermosensitive recording paper 2 is conveyed in the paper feeding direction, a full-color image is printed on the color thermosensitive recording paper 2 in a color frame sequential fashion. A leading portion of the color thermosensitive recording paper 2 having the full-color image printed thereon is cut into a sheet by a cutter 26 and ejected through an exit 25.

Figure 2:
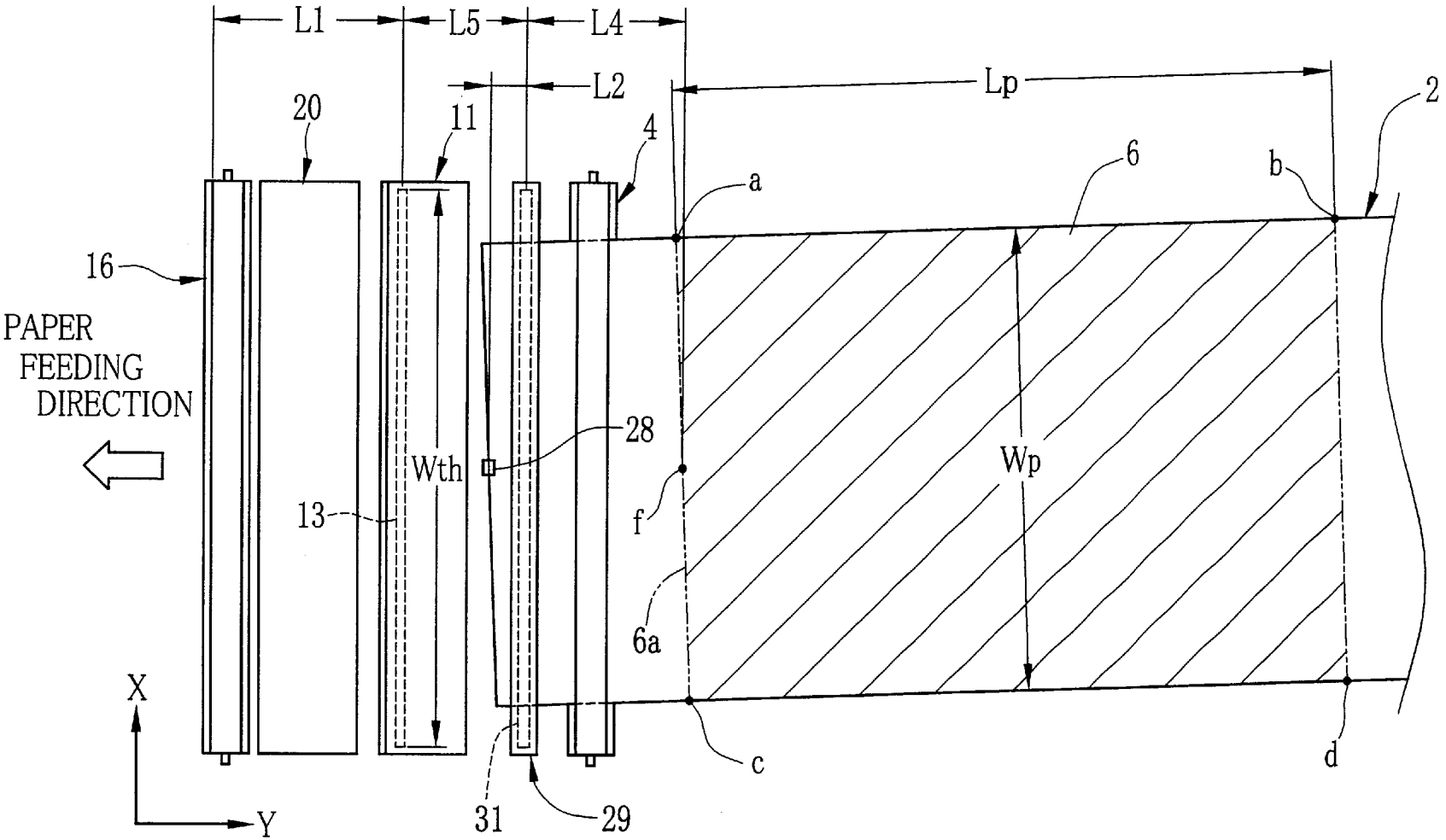
FIG. 2 is a schematic diagram of essential parts of the color thermosensitive printer viewed from upside a color thermosensitive recording paper.

As shown in FIG. 2, the heating element array 13 has a length Wth in the main scan direction, and the length Wth is larger than a width Wp, i.e. a length in the main scan direction, of the color thermosensitive recording paper 2. Which enables the thermal head 11 to record pixels across the entire width of the color thermosensitive recording paper 2 even while the color thermosensitive recording paper 2 is being conveyed a little slantingly to the sub scan direction. In FIG. 2, Lp designates a length in the sub scan direction of a frame area 6 on the color thermosensitive recording paper 2. The frame area 6 has the same width Wp as the color thermosensitive recording paper 2, whereas its length Lp may be defined for each image to print, so the image is printed individually in the frame area 6. Four corner points of the frame area 6 are designated by "a", "b", "c" and "d".

A photo interruptive sensor 28 and a photoelectric line sensor 29 are disposed before the thermal head 11 in the paper feeding direction, for detecting the leading end and a side edge of the color thermosensitive recording paper 2 respectively. The photo interruptive sensor 28 consists of a light projecting element 28*a* and a light receiving element 28*b* which are located under and over the paper path respectively. An optical path between the light projecting element 28*a* and the light receiving element 28*b* crosses a center line of the paper path that extends in the sub scan direction across a center point of the heating element array 13. The light receiving element 28*b* outputs a detection signal to a system controller 30 (see FIG. 3), when the color thermosensitive recording paper 2 interrupts light from the light emitting element 28*a*.

In this embodiment, the line sensor 29 uses a CCD array 31 having a plurality of CCD elements arranged in a line in the main scan direction. The CCD array 31 has the same length Wth as the heating element array 13, and its position in the main scan direction is aligned with that of the heating element array 13. Since the CCD array 31 extends beyond the width Wp of the color thermosensitive recording paper 2, it is possible to detect the side edge of the color thermosensitive recording paper 2 even if the color thermosensitive recording paper 2 is inclined relative to the sub scan direction. The line sensor 29 detects positions of the color thermosensitive recording paper 2 in the main scan direction at predetermined timings while the color thermosensitive recording paper 2 is being conveyed in the paper feeding direction, and outputs data of the detected edge positions to the system controller 30.

Figure 3:
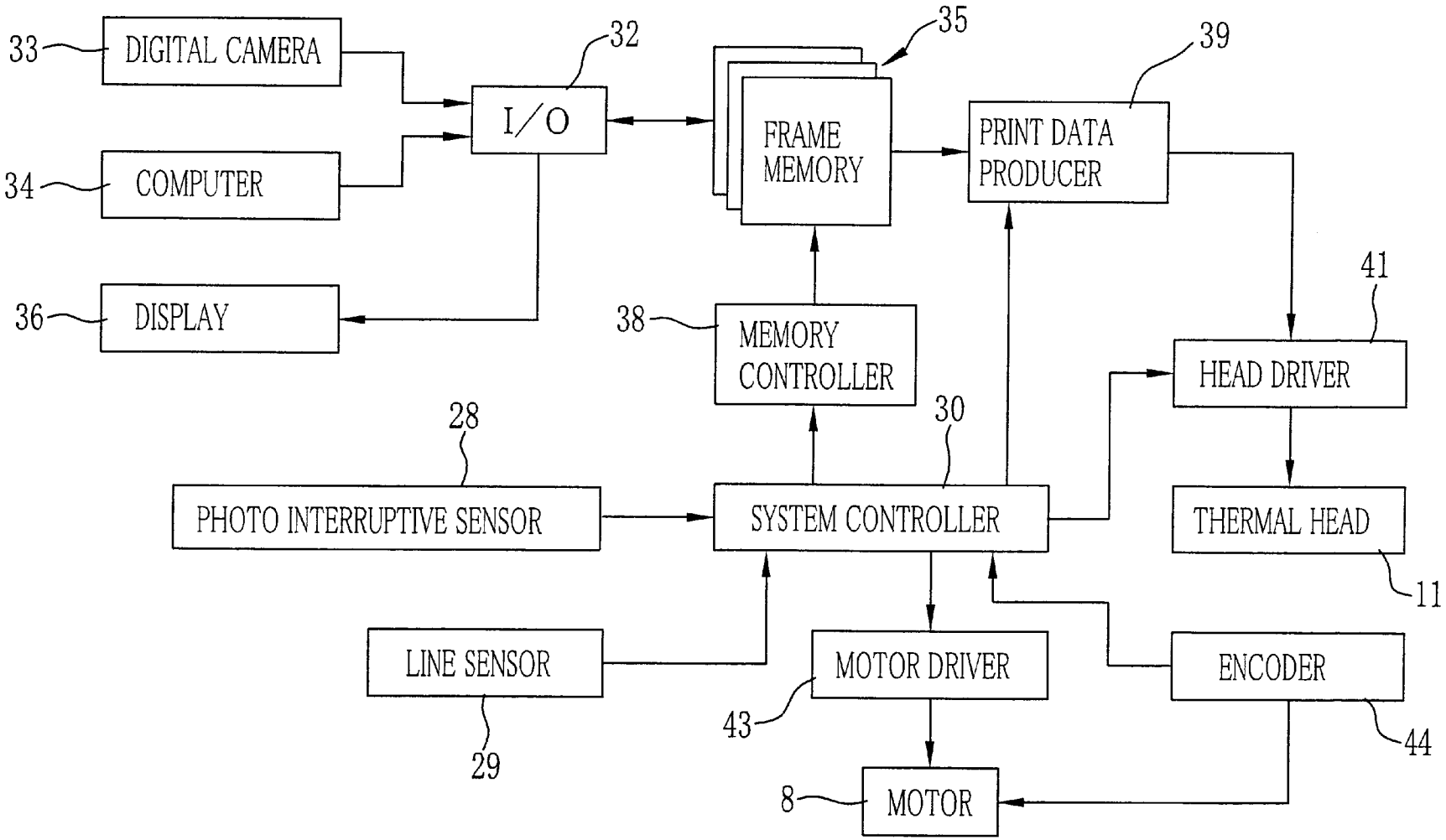
FIG. 3 is a block diagram of the thermosensitive color printer.

Reference is now made to FIG. 3 showing a circuitry of the color thermosensitive printer. The overall operation of the color thermosensitive printer is controlled by the system controller 30. The system controller 30 includes a CPU, a program ROM and a work RAM. The system controller 30 controls respective elements of the color thermosensitive printer in accordance with control programs stored in the program ROM, while using various data that are written temporarily in the work RAM.

The system controller 30 doubles as a recording position calculator. The edge position data detected through the line sensor 29 are written in the work RAM, and the CPU calculates a position of the frame area 6 relative to the thermal head 11 on the basis of the edge position data. Calculation formulas for calculating the relative position of the frame area 6 are stored in the program ROM.

An I/O circuit 32 is connected to not-shown I/O ports through which various kinds of external apparatuses, including a digital camera 33 and a computer 34, can feed image data in the color thermosensitive printer. The I/O circuit 32 separates the entered image data into three-color frame data for yellow, magenta and cyan, and writes the three-color frame data in frame memories 35 for the three colors. The I/O port also has a video output terminal for outputting NTSC composite signal to a display 36, like TV, for displaying a video image simulating a printed image.

The color frame data is read out from the frame memories 35 and written in a print data producer 39 through a memory controller 38 under the control of the system controller 30. As will be described in detail later, the print data producer 39 produces print data from the color frame data and blank data, and the print data is used for driving the heating element array 13 of the thermal head 11. The color frame data causes the heating element to record a pixel, but the blank data does not heat the heating element. Therefore, the heating elements driven with the blank data do not record any pixel. Locations of the pixel data and the blank data within the print data are determined in accordance with the relative position of the frame area 6 that is determined by calculation in the CPU.

In this embodiment, the color frame data is allocated to those heating elements which are in contact with the frame area 6 of the color thermosensitive recording paper 2, whereas the blank data is allocated to those heating elements which are not in contact with the color thermosensitive recording paper 2. Thereby, an image is printed in the entire frame area 6 without margins even while the heating elements are not driven uselessly while they are not in contact with the frame area 6. The blank data may have such a low value that would not heat the heating element up to a low temperature less than a biasing temperature, in order to prevent cooling those heating elements which are in contact with the border of the frame area 6.

The print data produced in the print data producer 39 is applied to a head driver 41, so the head driver 41 heats the heating element array 13 in accordance with the print data to do thermal recording on the respective thermosensitive coloring layers of the color thermosensitive recording paper 2 under the control of the system controller 30.

A motor driver 43 drives the motor 8 under the control of the system controller 30. An encoder 44 is mounted to the motor 8 to detect rotation of the motor 8, and outputs encoder pulses to the system controller 30. Based on the encoder pulses from the encoder 44, the system controller 30 calculates an advanced length of the color thermosensitive recording paper 2.

Now the operation of the color thermosensitive printer having the above constructions will be described.

Upon a print starting operation, the system controller 30 drives the motor 8 in a forward direction through the motor driver 43, so the paper supply roller pair 4 rotate to convey the color thermosensitive recording paper 2 in the paper feeding direction. When the leading end of the color thermosensitive recording paper 2 goes past the line sensor 29 and is detected by the photo interruptive sensor 28, the system controller 30 starts counting the encoder pulses from the encoder 44 to detect the advanced length of the color thermosensitive recording paper 2.

Figure 4:
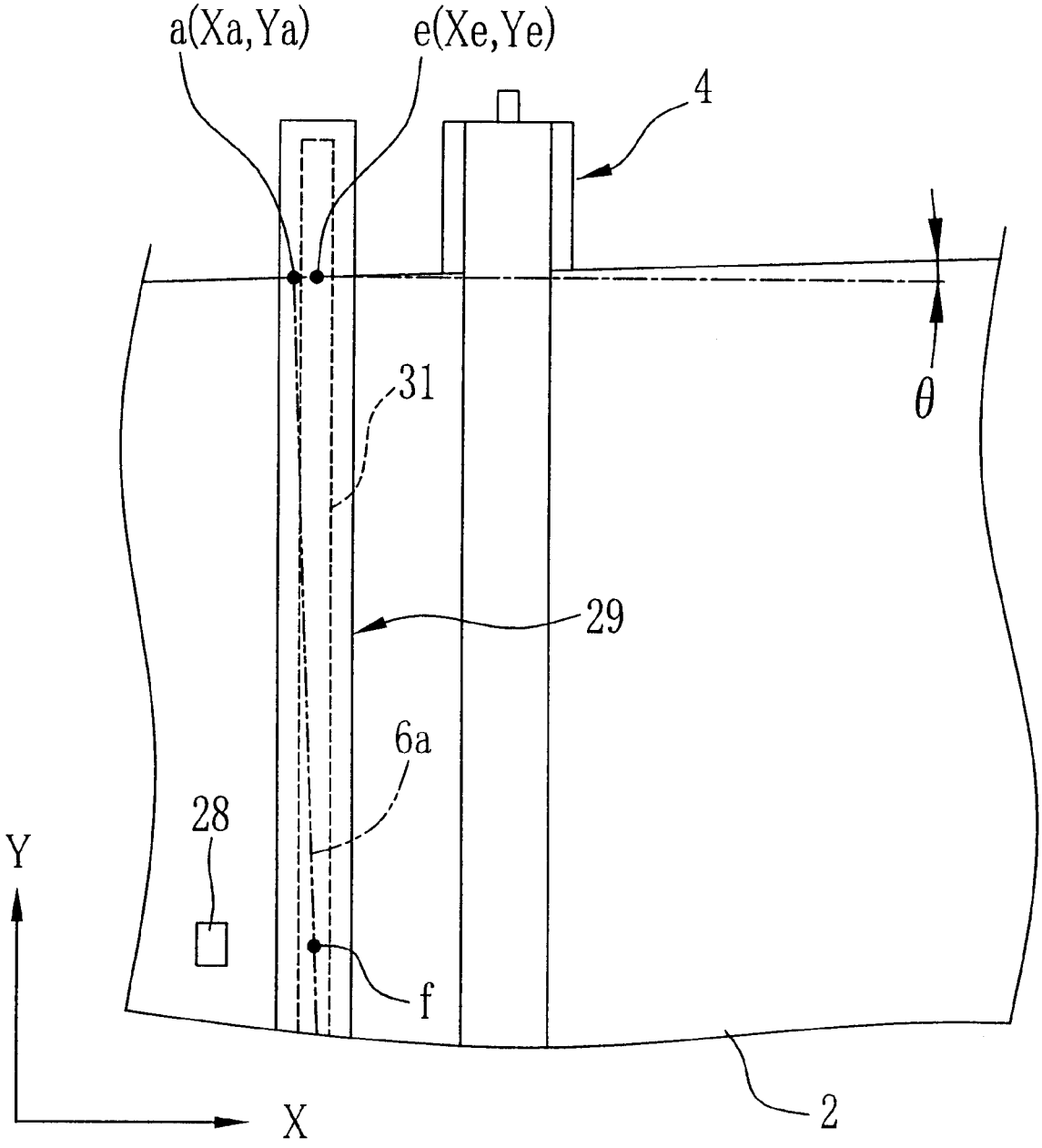
FIGS. 4 and 5 are explanatory diagrams illustrating an operation of a linear photoelectric sensor for detecting position of the color thermosensitive recording paper relative to the thermal head in the main scan direction.

At a timing when the color thermosensitive recording paper 2 is advanced by a length L3 from the detection of the leading end by the photo interruptive sensor 28, the system controller 30 drives the line sensor 29 to detect a side edge point "e" of the color thermosensitive recording paper 2, as shown in FIG. 4, wherein L3=L1−L2, and L1 is a distance between the heating element array 13 and a leading end of the pinch roller 16*b*, whereas L2 is a distance between the photo interruptive sensor 28 and the line sensor 29, respectively in the sub scan direction. A length L4 shown in FIG. 2 is approximately equal to the length L3.

Simultaneously, the system controller 30 determines a reference point "f" as a point on the color thermosensitive recording paper 2 that is opposed to a center point of the line sensor 29 in the main scan direction at the time of detection of the side edge point "e". Since the line sensor 29 is aligned with the heating element array 13 with respect to the main scan direction, the center point of the line sensor 29 is on the center line of the paper path.

The system controller 30 memorizes a location of the side edge point "e" with respect to the reference point "f" as a coordinate value (Xe,Ye) in the work RAM, wherein X- and Y-axes correspond to the main and sub scan directions respectively, and the reference point "f" is the center (0,0) of the coordinate. Since the side edge point "e" and the reference point "f" are concurrently opposed to the line sensor 29, these points are on the same line that extends in the main scan direction, so Xe=0, and (Xe,Ye)=(0,Ye).

Thereafter, the system controller 30 determines coordinate values of the corner points "a", "b", "c" and "d" of the frame area 6, on the assumption that the reference point "f" is on a leading end 6*a* of the frame area 6 in the paper feeding direction. The leading end 6*a* should extend perpendicularly to the side edges of the color thermosensitive recording paper 2. Therefore, the corner points "a" and "c" are at cross points between the side edges of the color thermosensitive recording paper and a line that includes the reference point "f" and meets at right angles with the side edges. So far as the color thermosensitive recording paper 2 is not inclined to the sub scan direction, the side edge point "e" coincides with the corner point "a". In the illustrated condition, however, the color thermosensitive recording paper 2 is slightly oblique to the sub scan direction, so the side edge point "e" does not coincide with the corner point "a".

Figure 5:
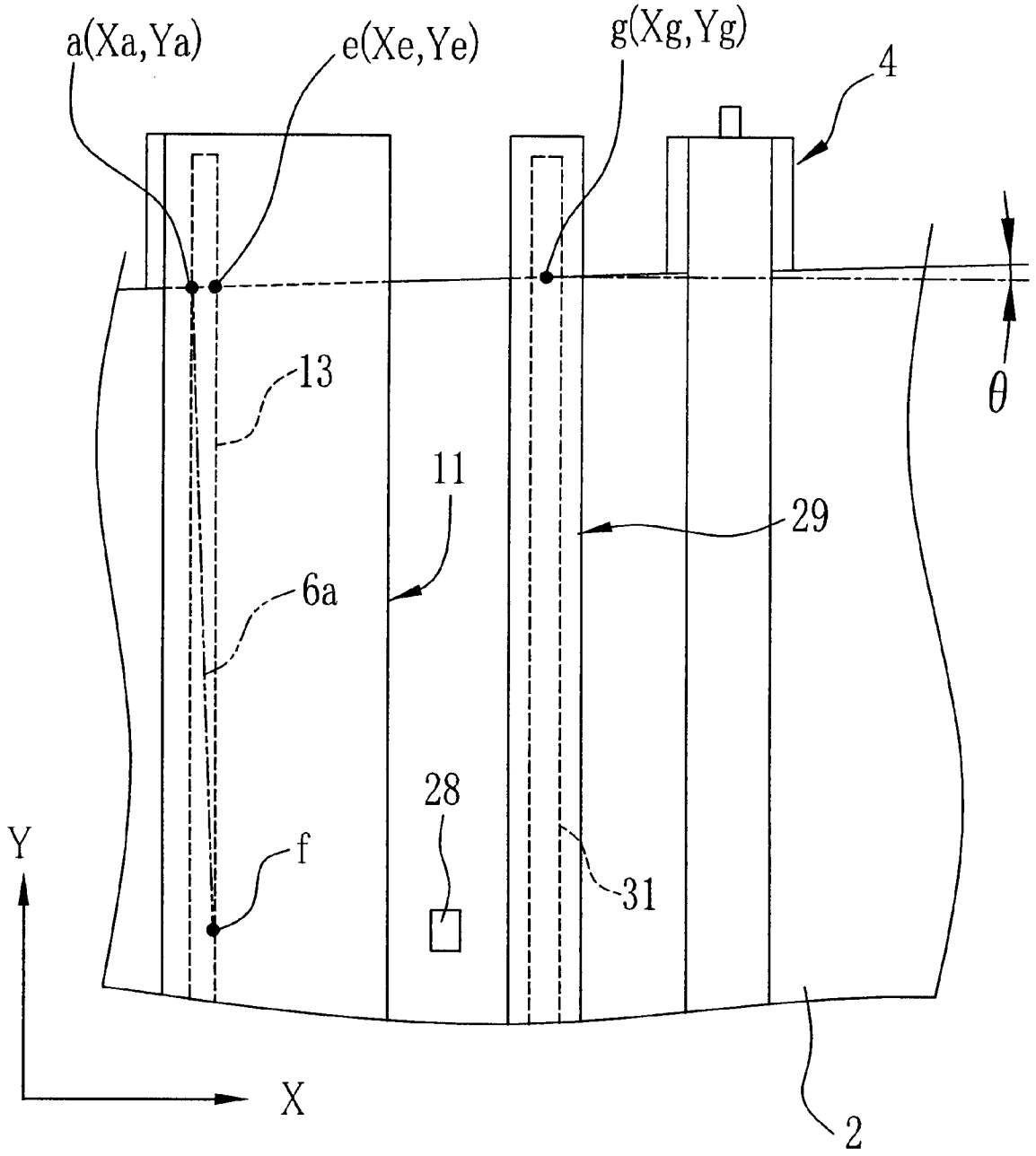

The system controller 30 continues counting the encoder pulses, to stop the motor 8 when the color thermosensitive recording paper 2 is advanced by a length L5 from the position where the side edge point "e" is detected by the line sensor 29. The length L5 is equal to a distance between the line sensor 29 and the heating element array 13, so the reference point "f" faces the heating element array 13 when the motor 8 and thus the color thermosensitive recording paper 2 stop in this way, as shown in FIG. 5. Because the reference point "f" is located at a distance L2+L4 from the leading end of the color thermosensitive recording paper 2 in the sub scan direction, and the distance L2+L4 is approximately equal to L2+L3=L1, the leading end of the color thermosensitive recording paper 2 is nipped between the conveyer rollers 16*a* and 16*b* in this stop position of the recording paper 2.

While the color thermosensitive recording paper 2 stops, the system controller 30 drives the line sensor 29 again to detect another side edge point "g", and calculates a coordinate value (Xg,Yg) of this side edge point "g" with respect to the reference point "f". The coordinate value (Xg,Yg) is stored in the work RAM, wherein Xg is equivalent to the length L5, and Yg may be obtained by converting the location of the side edge point "g" relative to the center point of the line sensor 29 into a length.

Then the system controller 30 calculates the relative position of the frame area 6 to the thermal head 11 based on the coordinate values of the side edge points "e" and "g" stored in the work RAM by use of the formulas stored in the program ROM.

Specifically, the system controller 30 first calculates an inclination angle θ of the color thermosensitive recording paper to the sub scan direction (=X). As well-known, a coordinate value (X,Y) of a point on a line can be expressed as follows with coefficients k1 and k2: Y=k1·X+k2.

Accordingly a straight line extending between the side edge points "e" and "g" is obtained by use of the following conditions:

$$Ye=k1\cdot Xe+k2 \quad (1)$$

$$Yg=k1\cdot Xg+k2 \quad (2)$$

Based on the conditions (1) and (2), the coefficients k1 and k2 may be obtained as follows:

$$Ye-Yg=k1(Xe-Xg)$$

$$k1=(Ye-Yg)/(Xe-Xg) \quad (3)$$

$$k2=Ye-k1\cdot Xe$$

$$k2=Ye-\{Xe(Ye-Yg)/(Xe-Xg)\} \quad (4)$$

According to the condition (3), k1=tan θ, so the inclination angle θ of the color thermosensitive recording paper 2 may be given as follows:

$$\theta=\tan^{-1}\cdot k1 \quad (5)$$

Next, a coordinate value (Xa,Ya) of the corner point "a" is calculated by utilizing the inclination angle θ of the color thermosensitive recording paper 2 that is obtained according to the conditions (4) and (5). Since the coordinate value of the side edge point "e" is (0,Ye), Ye=k2 according to the condition (1). Also, the length of a line "a–f" that connects the corner point "a" to the reference point "f" is given as an equation: a–f=k2·cos θ. So the coordinate value (Xa,Ya) of the corner point "a" is given as follows:

$$Xa=-a-f\cdot\sin\theta=-k2\cdot\sin\theta\cdot\cos\theta$$

$$Ya=a-f\cdot\cos\theta=k2\cdot\cos^2\theta$$

Since the length Lp of the frame area 6 is predetermined, a coordinate value (Xb,Yb) of the corner point "b" with respect to the reference point "f" is given as follows:

$$Xb=Xa+Lp\cdot\cos\theta$$

$$Yb=Ya+Lp\cdot\sin\theta$$

Since the width Wp of the frame area 6 is also known, a coordiate value (Xc,Yc) of the corner point "c" is given as follows:

$$Xc=Xa+Wp\cdot\sin\theta$$

$$Yc=Ya-Wp\cdot\cos\theta$$

In the same way, a coordinate value (Xd,Yd) of the corner point "d" is given as follows:

$$Xd=Xc+Lp\cdot\cos\theta$$

$$Yd=Yc+Lp\cdot\sin\theta$$

Figure 6:
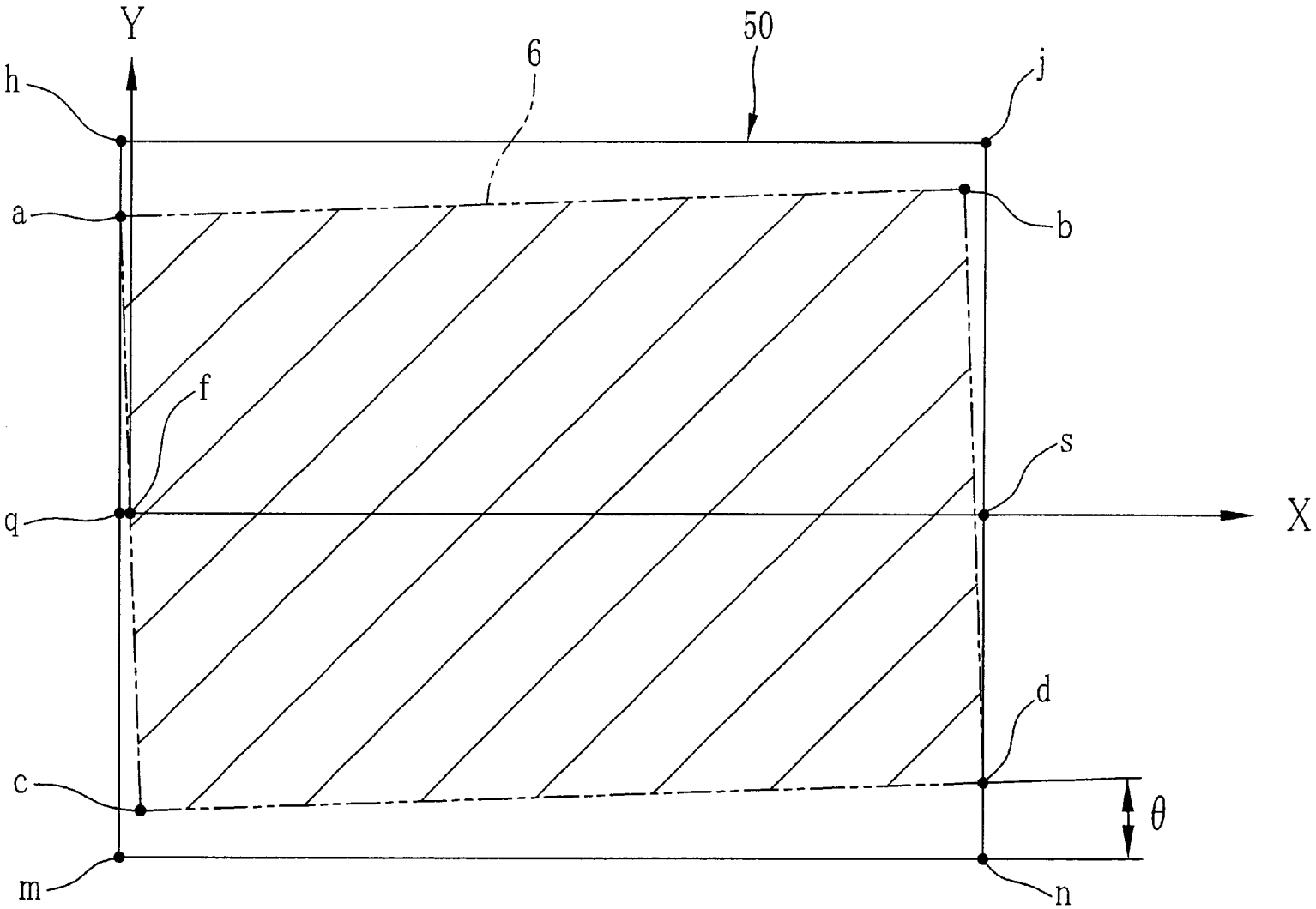
FIG. 6 is an explanatory diagram illustrating a relationship between a frame area on the color thermosensitive recording paper in which an image is printed without any margins and a scanning area that is defined by a main scanning range and a sub scanning range of a thermal head of the thermosensitive printer and corresponds to print data applied to the thermal head for printing of that image.

By obtaining the coordinate values of the respective corner points "a" to "d" of the frame area 6 in this way, the relative position of the frame area 6 to the thermal head 11 is determined. Then the system controller 30 controls the memory controller 38 to transfer the respective color frame data from the frame memories 35 to the print data producer 39. From the color frame data, the print data producer 39 produces the print data for the three colors. The print data is defined to cover a rectangular scanning area 50 of the thermal head 11, as shown in FIG. 6, wherein four corner points of the scanning area 50 are designated by "h", "j", "m" and "n". The scanning area 50 is defined by the main scanning range and a sub scanning range of the thermal head 11, and the main scanning range corresponds to the length Wth of the heating element array 13 in this embodiment, whereas the sub scanning range corresponds to an advanced length of the recording paper 2 relative to the thermal head 11 while the thermal head 11 is activated for recording one frame.

Two sides h–m, j–n of the scanning area 50, which extend in the main scan direction (=Y), have the same length Wth as the heating element array 13 and circumscribe the frame area 6. That is, the two sides h–m, j–n represent the main scanning range Wth, whereas other two sides h–j and m–n represent the sub scanning range. Designated by "q" and "s" are respective center points of the lines h–m, j–n, which correspond to the center point of the heating element array 13. Accordingly, lines h–q, q–m, j–s, s–n have a length of Wth/2. Also, the line q–s corresponds to the center line of the paper path. So it is easy to obtain coordinate values (Xh,Yh), (Xj,Yj), (Xm,Ym) and (Xn,Yn) of the corner points "h", "j", "m" and "n" of the scanning area 50 with respect to the reference point "f" on the basis of the following equations:

$$Xh=Xm=Xa$$

$$Yh=Yj=Wth/2$$

$$Xj=Xn=Xd$$

$$Ym=Yn=-Wth/2$$

As described above, the print data consists of the image data and the blank data. The print data producer 39 first defines the size of the scanning area 50, and compares it with the frame area 6 on the basis of the relative position of the frame area 6 to the thermal head 11. Then, the print data producer 39 produces the print data from the image data, i.e. the color frame data read out from the frame memory 35, and the blank data. The print data producer 39 rotates the color frame data in accordance with the inclination angle θ of the color thermosensitive recording paper 2, and allocates the color frame data to a location of the print data that corresponds to a location of the frame area 6 within the scanning area 50, as shown by hatching in FIG. 6. To those locations of the print data that correspond to peripheral portions of the scanning area 50 that are excluded from the frame area 6, the print data producer 39 allocates the blank data.

Figure 7:
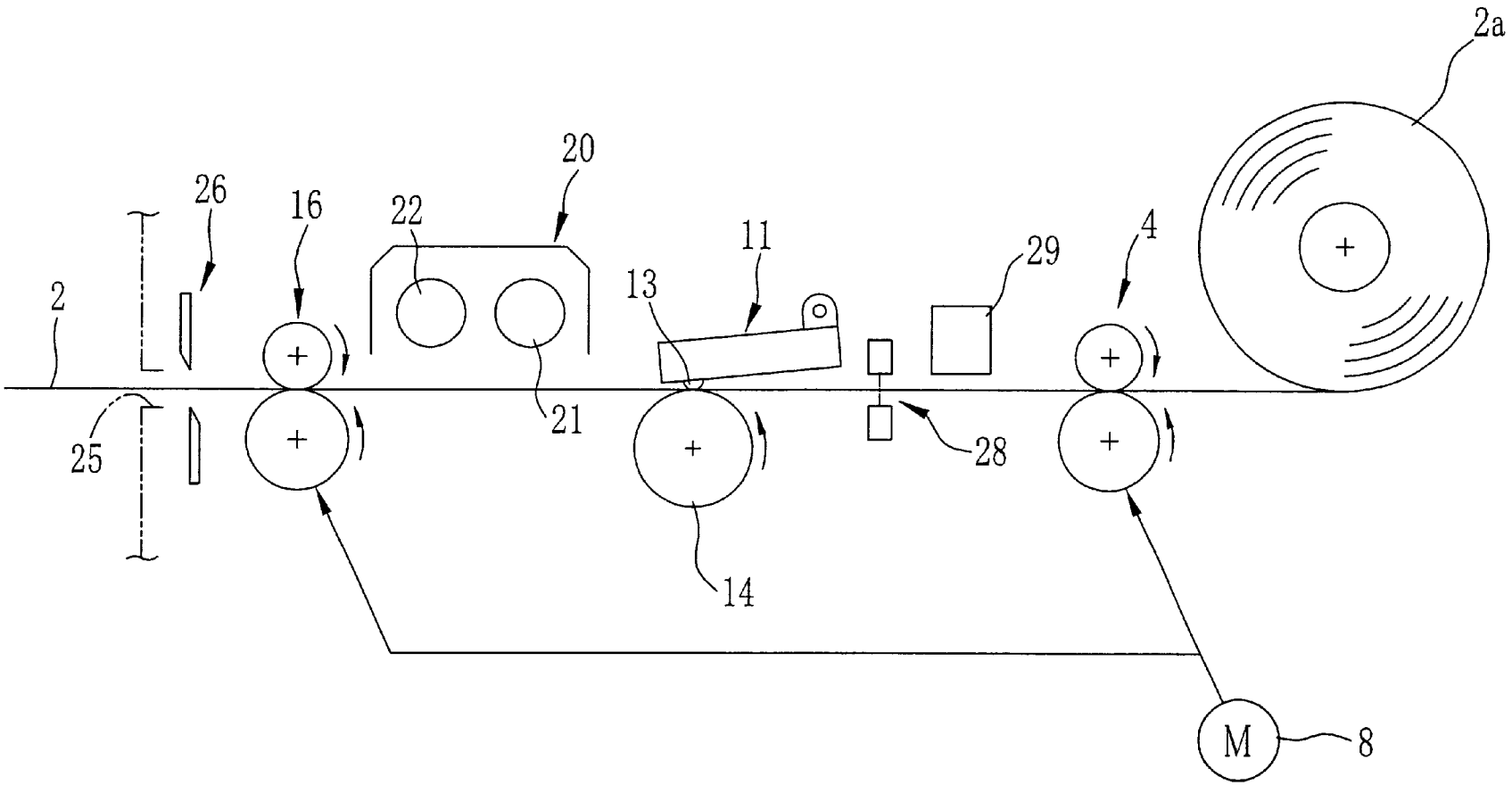
FIG. 7 is a similar view to FIG. 1, but illustrating the color thermosensitive printer in a printing condition.

After the print data producer 39 produces the print data in this way, the thermal head 11 is moved to the recording position to press the color thermosensitive recording paper 2 onto the platen roller 14, as shown in FIG. 7. Then, the motor 8 is driven again to convey the color thermosensitive recording paper 2 in the paper feeding direction.

As the color thermosensitive recording paper 2 moves in the paper feeding direction, the head driver 41 drives the heating element array 13 in accordance with the print data for yellow from the print data producer 39. Since the image data of each line is allocated to those heating elements which are in contact with the frame area 6 of the color thermosensitive recording paper 2, yellow pixels are recorded line by line in the entire frame area 6. On the other hand, those heating elements which are not in contact with the frame area 6 would not be heated because the blank data is allocated to these heating elements.

After the yellow frame is completely recorded, the motor 8 stops rotating, and the thermal head 11 is moved to the retracted position. Then, the motor 8 is driven reversely to convey the color thermosensitive recording paper 2 in reverse to the paper feeding direction. As the color thermosensitive recording paper 2 is conveyed in reverse, the yellow fixing lamp 21 is turned on to fix the yellow thermosensitive coloring layer of the color thermosensitive recording paper 2.

When the print starting line or leading end 6*a* of the frame area 2 is placed under the heating element array 13 again, the motor 8 stops rotating reversely, and the thermal head 11 is moved to the recording position. The motor 8 is then driven to convey the color thermosensitive recording paper 2 in the paper feeding direction again. As the color thermosensitive recording paper 2 moves in the paper feeding direction, those heating element which are in contact with the frame area 6 are driven with the magenta frame data included in the print data, while those out of the frame area 6 are driven with the blank data. Thus, the magenta frame is recorded line by line in the entire frame area 6.

After the magenta frame is completely recorded, the motor 8 stops rotating, and the thermal head 11 is moved to the retracted position. Then, the motor 8 is driven reversely to convey the color thermosensitive recording paper 2 in reverse to the paper feeding direction. As the color thermosensitive recording paper 2 is conveyed in reverse, the magenta fixing lamp 22 is turned on to fix the magenta thermosensitive coloring layer of the color thermosensitive recording paper 2.

When the leading end 6*a* returns to the heating element array 13, the motor 8 stops rotating reversely, and the thermal head 11 is moved to the recording position. The motor 8 is then driven to convey the color thermosensitive recording paper 2 in the paper feeding direction. Then, the heating element array 13 is driven with the print data for cyan, so the cyan frame is recorded line by line in the entire frame area 6 in the same way as for yellow and magenta.

Since those heating elements which are not in contact with the frame area 6 are not heated, problems caused by unused heat energy are solved, and also waste of heat energy is minimized.

When the leading end 6*a* reaches the cutter 26 during the thermal recording of the cyan frame, the cutter 26 is activated to cut the color thermosensitive recording paper 2 along a line that extends in the main scan direction from a rearward one of the corner points on the leading end 6*a* in the paper feeding direction, i.e., from the corner point "c" in the illustrated embodiment. Thereby, an undesirable blank or margin would not be provided on the leading end of the printed image even if the recording paper 2 is inclined.

When the cyan frame is completely recorded, the thermal head 11 is retracted. The motor 8 continues rotating forwardly to convey the color thermosensitive recording paper 2 further in the paper feeding direction. Because the cyan thermosensitive coloring layer would not color under normal preservative conditions, it is not subjected to optical fixation.

While the color thermosensitive recording paper 2 is ejected through the exit 25, the cutter 26 is activated to cut the color thermosensitive recording paper 2 along a line that extends in the main scan direction from a forward one of the corner points "b" and "d" with respect to the paper feeding direction, i.e., from the corner point "b" in this embodiment. In this way, a sheet of printed image with no margin is provided.

It is preferable to make the cutter 26 adjustable to the inclination of leading and trailing ends of the frame area 6 relative to the main scan direction, so that the color thermosensitive recording paper 2 is cut into an exactly rectangular sheet. After the printed sheet is ejected, the remaining recording paper 2 is wound back onto the paper roll 3.

Figure 8:
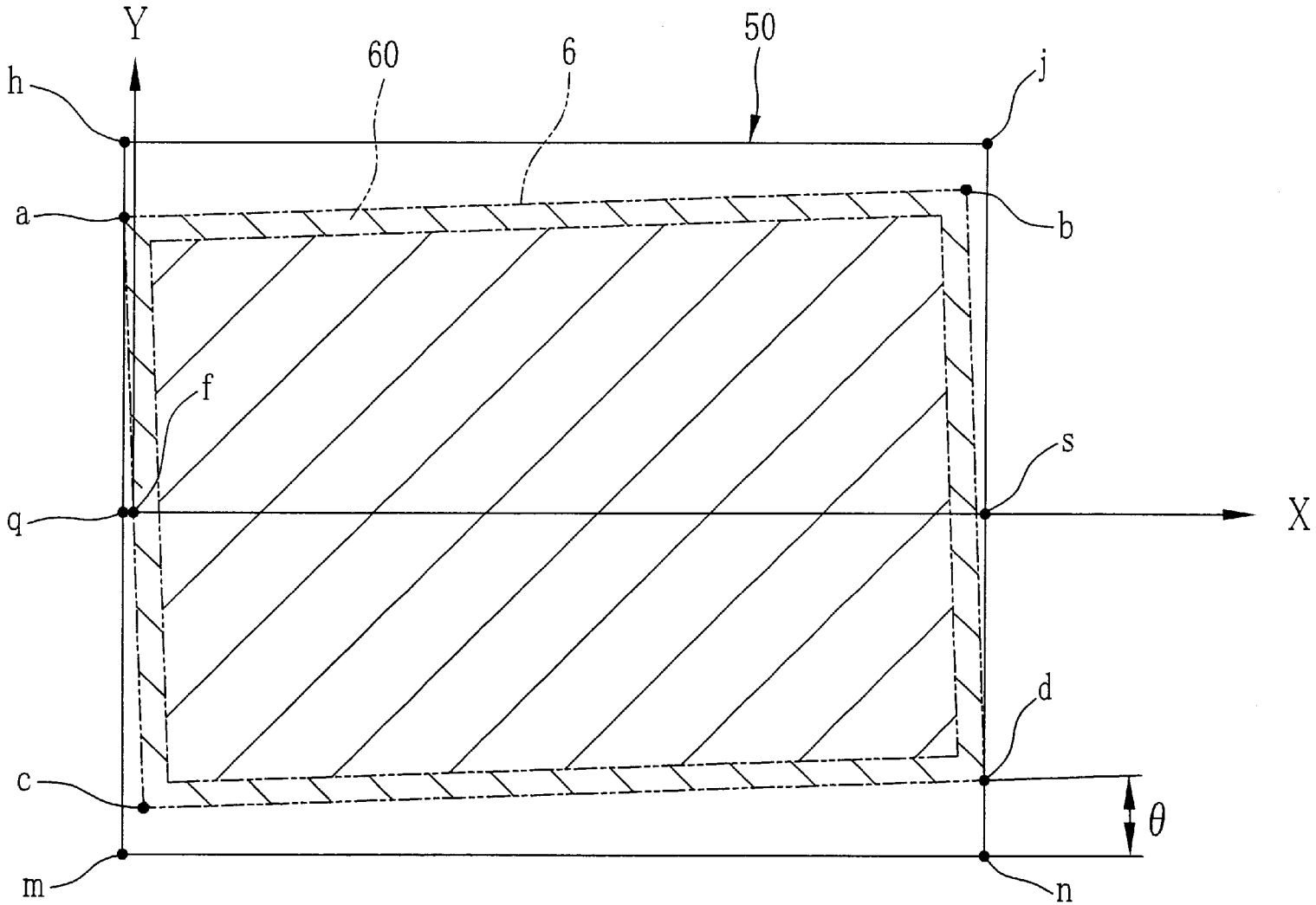
FIG. 8 is a similar view to FIG. 6, but illustrating a case where an image is printed with margins of an equal width in the frame area.

Although the image is printed without any margin in the above embodiment, the present invention makes it possible to print an image with margins of predetermined widths even when the frame area 6 is inclined relative to the sub scan direction, as shown in FIG. 8. In that case, the blank data is allocated not only to the peripheral portions of the scanning area 50 outside the frame area 6, but also to marginal portions of the frame area 6. Thereby, margins 60 of a constant width are provided around the image in the embodiment of FIG. 8. It is also possible to provide margins only on opposite sides of the image, or a margin on one side of the image. Instead of a constant width, the width of the margin may be modified in a pattern to form a zigzag framing line or a wavy framing line or the like.

Furthermore, the line sensor 29 may be replaced by a line sensor having a half length of the heating element array 13 and extending in the main scan direction from the center line of the paper path to one lateral side of the paper path, provided that the center line crosses the center point of the heating element array 13 in the sub scan direction.

Figure 9:
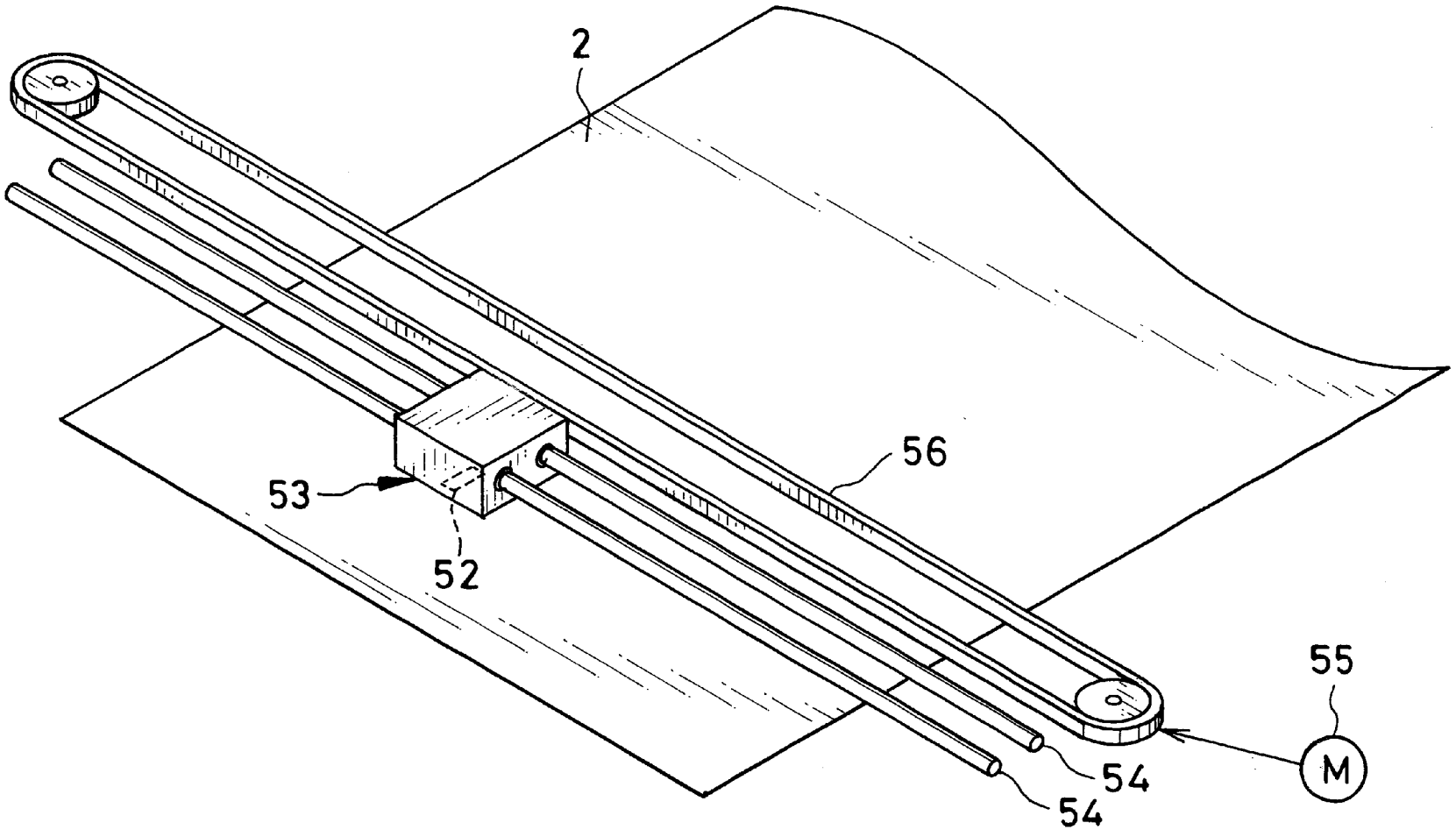
FIG. 9 is a perspective view of a photoelectric sensor used for detecting position of the color thermosensitive recording paper relative to the thermal head in the main scan direction, according to another embodiment of the present invention.

Instead of the line sensor consisting of the CCD array, it is possible to use a detection head 53 with a single CCD element 52 for detecting the side edge of the color thermosensitive recording paper 2, as shown in FIG. 9. The detection head 53 is mounted on a pair of guide shafts 54 that extend in the main scan direction. The detection head 53 is fastened to an annular belt 56 that is circulated by a motor 55, so the detection head 53 may slide along the guide shafts 54 to detect the side edge of the color thermosensitive recording paper 2.

The present invention is applicable to those cases where the image is printed on a sheet of recording paper that is previously cut into a predetermined length. Although the width of the color thermosensitive recording paper is predetermined in the above embodiment, it is possible to use different widths of recording paper insofar as the width is less than the length of the heating element array 13. In that case, opposite side edges of the color thermosensitive recording paper are detected in order to determine the paper width.

The present invention has been described so far with respect to the color thermosensitive printer, the present invention is applicable to any kinds of line printers. Now, an embodiment of an optical line printer according to the present invention will be described.

Figure 10:
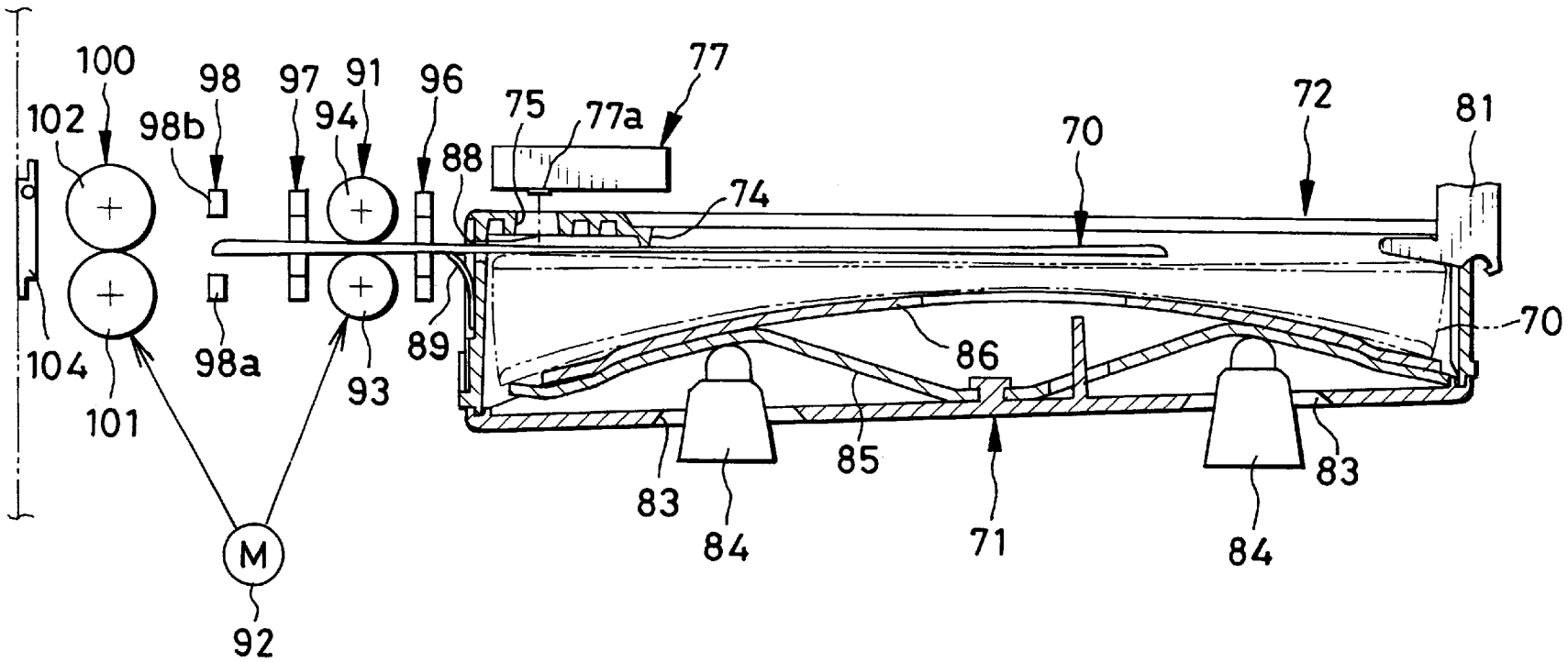
FIG. 10 is a schematic diagram illustrating an optical line printer according to an embodiment of the invention.
Figure 11:
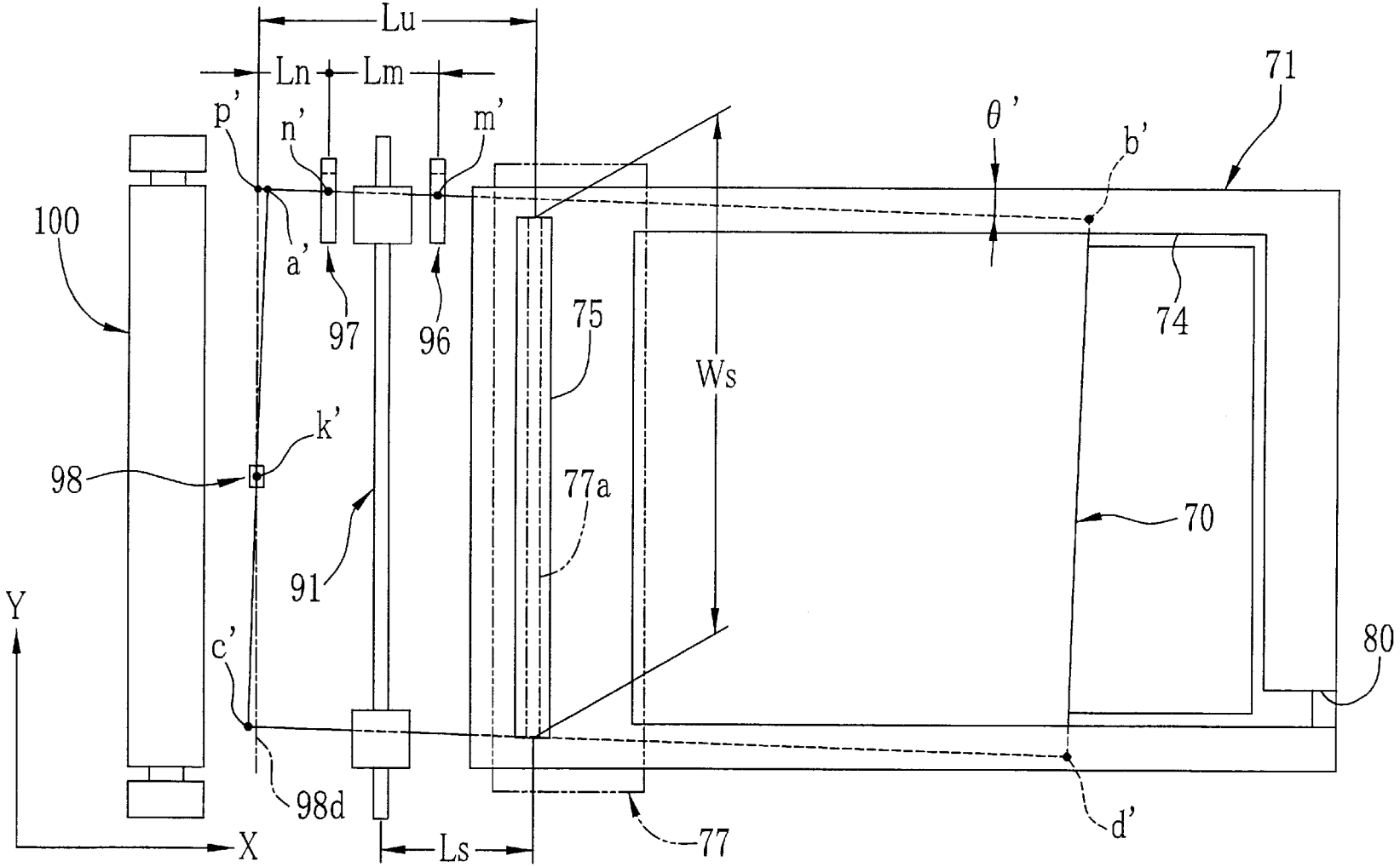
FIG. 11 is a schematic diagram illustrating essential parts of the optical line printer viewed from upside an instant photo film.

FIGS. 10 and 11 show the optical line printer that prints a full-color image on an instant or self-developing type photo film 70. Although it is omitted from the drawings, the optical line printer has a film pack chamber for holding an instant film pack 72 therein. As well-known in the art, the instant film pack 72 contains a stack of instant photo films 70 in a generally parallelepiped plastic case 71.

Figure 12:
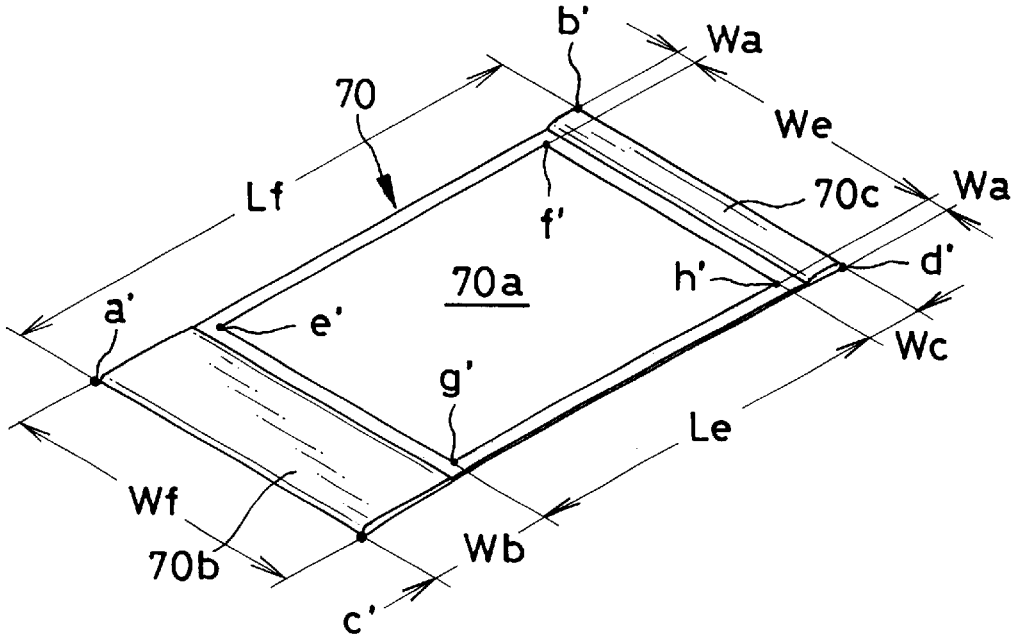
FIG. 12 is a perspective view of the instant photo film.

As shown in FIG. 12, the instant photo film 70 has an exposure area 70*a* on one surface thereof that consist of a photosensitive layer and an image forming layer, and also a pod 70*b* of processing fluid and a trap portion 70*c* along leading and trailing marginal portions respectively. The trap portion 70*c* traps and cures the remainder of the processing fluid after it is spread over the exposure area 70*a*. In this embodiment, the instant photo film 70 is of mono-sheet type.

Figure 13:
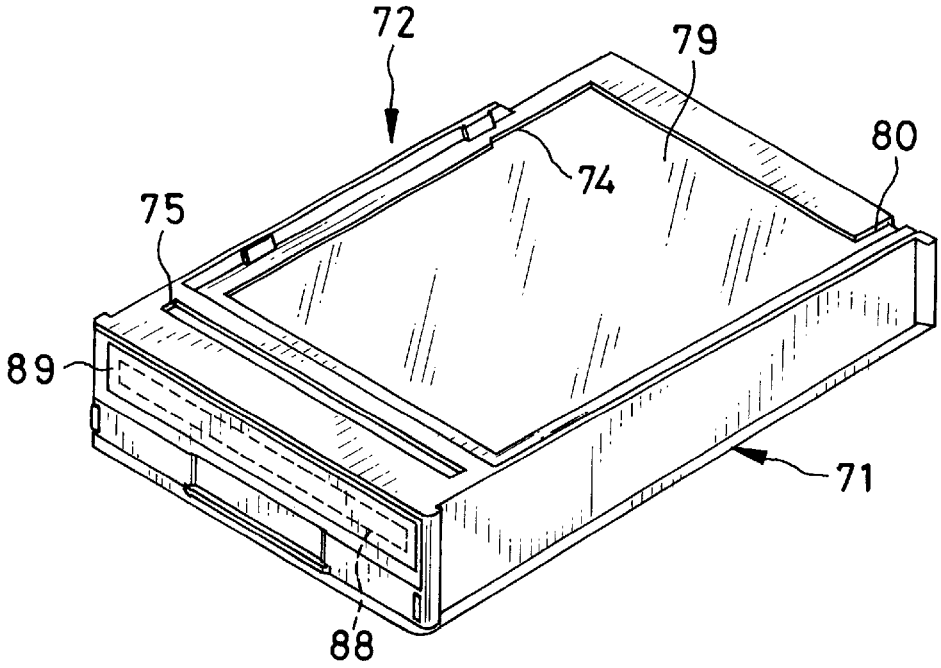
FIG. 13 is a perspective view of an instant film pack for used in the optical line printer.

As shown in FIG. 13, the case 71 of the instant film pack 72 has a large rectangular exposure aperture 74 and a small linear exposure aperture 75 formed through a top side. The large exposure aperture 74 is sized to expose the entire exposure area 70*a* of the instant photo film 70 as contained therein. The whole exposure area 70*a* may be exposed at once through the large exposure aperture 74 for example when the instant film pack 72 is loaded in an instant camera. The small exposure aperture 75 is located outside the exposure area 70*a*, in opposition to the solution pod 70*b* of the instant photo film 70 as contained in the case 71. When the instant film pack 72 is loaded in the optical line printer, the small exposure aperture 75 is opposed to an optical printing head 77 of the printer, as shown in FIGS. 10 and 11.

Before the instant film pack 72 is used, the exposure apertures 74 and 75 are closed by a light-tight plastic sheet 79 that is put atop the stack of instant photo films 70 in the case 71. After the instant film pack 72 is loaded in the optical line printer or an instant camera, the light-tight sheet 79 is advanced out of the case 71 through an ejection slot 88 by a well-known raking mechanism of the printer or the camera. In the unused condition, a light-tight film 89 is stuck to the case 71 to close the ejection slot 88 from outside. A claw member 81 of the raking mechanism is partly shown in FIG. 10. The claw member 81 moves into the case 71 through a cutout 80 that is formed at a trailing end portion of the case 71 with respect to the film advancing direction, as shown in FIG. 11, to pushes the light-tight sheet 79 or the instant photo film 70 at its trailing edge in the film advancing direction. The cutout 80 is shielded from ambient light by a light-tight film that is attached to the light-tight sheet 79, so the light-tight film is ejected together with the light-tight sheet 79. While being advanced, the light-tight sheet 79 pushes the light-tight film 89 off the ejection slot 88.

As shown in FIG. 10, two openings 83 are formed through a bottom wall of the case 71. When the instant film pack 72 is placed in the film pack chamber, push-up members 84 mounted in the film pack chamber enter the case 71 through the openings 83. The bottom openings 83 are closed by a pair of light-tight plastic plates 85 and 86 which are mounted inside the case 71. The plastic plates 85 and 86 have an appropriate resiliency and support the bottommost instant photo film 70 of the stack at its fringes. Thus, the push-up members 84 push up the stack of instant photo films 70 through the plastic plates 85 and 86, to keep the topmost instant photo film 70 flat and straight behind the exposure apertures 74 and 75.

In the optical line printer, the instant photo film 70 is successively advanced out of the case 71 through the ejection slot 88, in a lengthwise direction thereof with the solution pod 70*b* in the lead, and the optical printing head 77 is activated to expose the advancing instant photo film 70 through the small exposure aperture 75.

As shown in FIG. 12, the instant photo film 70 has an external width Wf and an external length Lf, whereas the exposure area 70*a* has a width We and a length Le. The solution pod 70*b* and the trap portion 70*c* have a length Wb and a length Wc respectively in the film advancing direction, wherein Wb+Le+Wc=Lf. A fringe around the exposure area 70*a* has a width Wa on either lateral side of the exposure area 70*a*, wherein Wa=(Wf−We)÷2.

Although it is omitted from the drawings, the optical printing head 77 has an array of light emitting elements for red, green and blue, and a micro lens array for converging the light from the light emitting elements. The micro lens array consists of a plurality of micro cylindrical lenses made of graded index type optical fibers, called SELFOC (a trade name). The light from the micro lens array is projected from a light slit 77*a* that faces the small exposure aperture 75, so a slit of light is projected onto the exposure area 70*a* through the exposure aperture 75.

More specifically, the light emitting elements, e.g. micro LEDs, are arranged in three rows, one row for one color. The rows extend in a main scan direction (=Y in FIG. 11) transverse to the film advancing direction of the instant photo film 70 out of the case 71. The three-color light emitting elements are driven simultaneously at regular intervals in synchronization with the advancing movement of the instant photo film 70. The red, green and blue light beams from three light emitting elements of the same column are converged through a common micro lens of the micro lens array at a point on the exposure area 70*a*. Each point corresponds to one pixel of the image to print. Thus, three color dots of one pixel are recorded concurrently, and a line of pixels extending in the main scan direction are recorded at each interval of emission of the light emitting array. Thus, the full-color image is recorded line by line as the instant photo film 70 moves past the optical printing head 77 only once.

The light slit 77*a* of the printing head 77 has a length Ws in the main scan direction, that is longer than a width We of the exposure area 70*a*, i.e. a length We in the main scan direction of the exposure area 70*a* of the advancing instant photo film 70 (see FIG. 12), which allows the printing head 77 to print the image without margins on lateral sides even when the instant photo film 70 is shifted in the main scan direction or inclined to a perpendicular direction to the main scan direction.

Two feed roller pairs 91 are disposed behind the ejection slot 88. Each feed roller pair 91 consist of a capstan roller 93 driven by a motor 92 and a pinch roller 94 rotated along with the capstan rollers 93. The capstan rollers 93 are mounted on an common axle, and the pinch rollers 94 are mounted on an common axle. The capstan roller 93 and the pinch roller 94 of each pair nip the advancing instant photo film 70 at its lateral side, so that the solution pod 70*b* may not be crashed by the feed roller pairs 91. To have the instant photo film 70 nipped between the feed rollers 91 before the exposure area 70*a* comes under the small exposure aperture 75, the feed rollers 91 are spaced from the small exposure aperture 75 by a distance Ls that is less than the length Wb of the solution pod 70*b*.

A first side edge detector 96 and a second side edge detector 97 are disposed before and behind one of the feed roller pairs 91 in the film advancing direction, for detecting one lateral side of the advancing instant photo film 70. A photo interruptive sensor 98 is disposed at a downstream position from the second side edge detector 97, for detecting a leading end of the instant photo film 70. The photo interruptive sensor 98 consists of a light projecting element 98*a* and a light receiving element 98*b*, which are disposed under and over a film advancing path. The light projecting element 98*a* emits infrared rays that would not fog the instant photo film 70. An optical path between the light projecting element 98*a* and the light receiving element 98*b* crosses a center line of the film advancing path that extends in a sub scan direction perpendicular to the main scan direction across a center point of the light slit 77*a* of the optical printing head 77.

In the sub scan direction, the photo interruptive sensor 98 is spaced from the light slit 77*a* by a distance Lu, and from the second side edge sensor 97 by a distance Ln, whereas the first and second side edge detectors 96 and 97 are spaced from each other by a distance Lm. As will be described in detail later, the first and second side edge detectors 96 and 97 detect two side edge points of the instant photo film 79 simultaneously when the photo interruptive sensor 98 detects a leading edge point, and a relative position of the instant photo film 70 to the light slit 77*a* is determined based on positions of the two side edge points relative to the leading end point.

Figure 14:
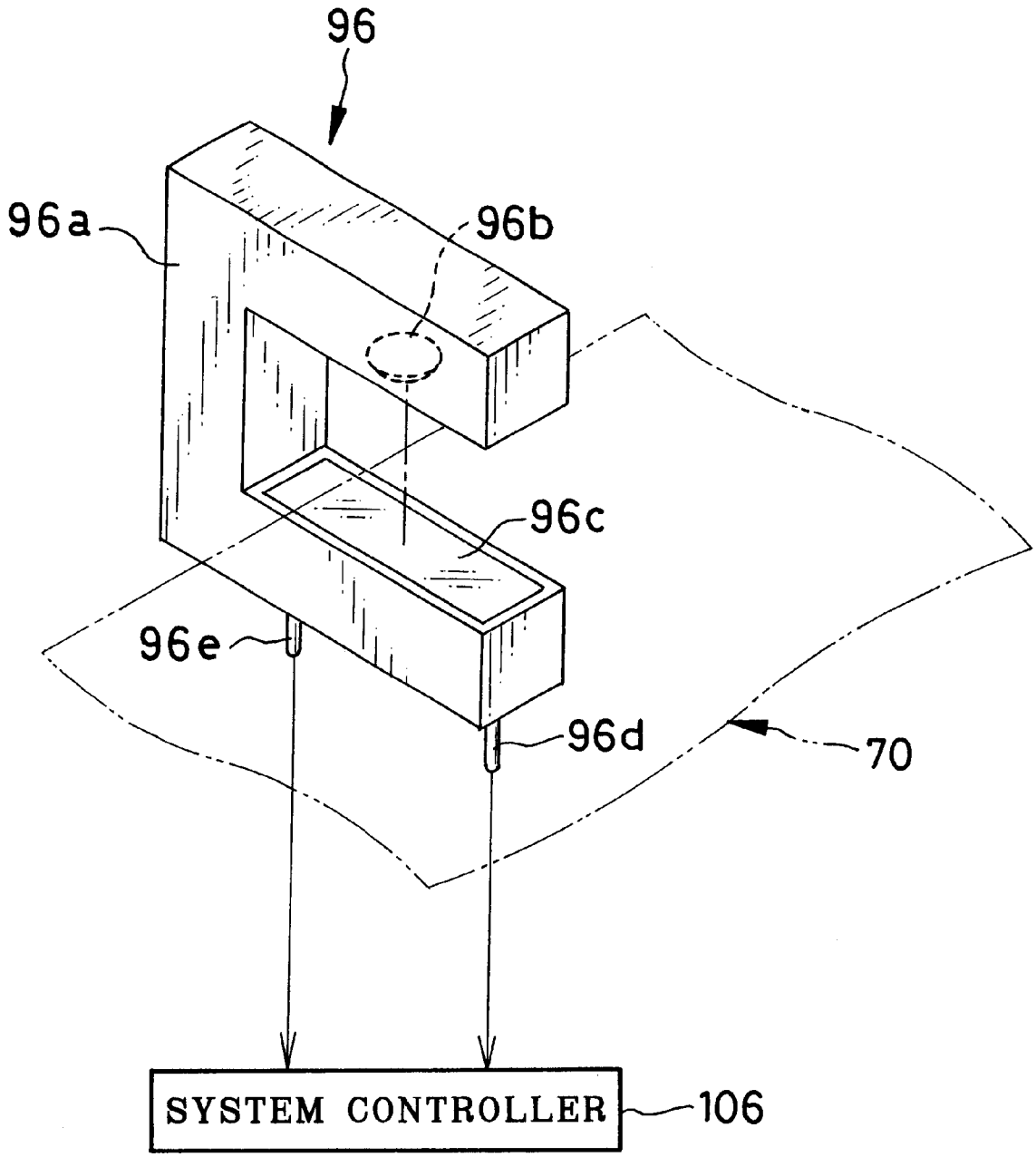
FIG. 14 is a schematic perspective view of a side edge position detector.

FIG. 14 shows the first side edge detector 96 in detail. The second side edge detector 97 has the same construction as the first side edge detector 96. The side edge detector 96 has a channel-shaped frame 96*a*, and a light projecting section 96*b* and a light receiving section 96*c* are mounted in opposite ends of the frame 96*a*. The light projecting section 96*b* and the light receiving section 96*c* are disposed over and under one lateral side of the film advancing path. The light receiving section 96*b* is a semiconductor-type position sensitive detector (PSD), and outputs detection signals from two output terminals 96*d* and 96*e* to a system controller 106 when the light receiving section 96*c* receives near-infrared rays from the light projecting section 96*b*.

While there is no interruption between the light projecting section 96*b* and the light receiving section 96*c*, the near-infrared rays from the light projecting section 96*a* falls onto a middle portion of a light receiving surface of the light receiving section 96*c*, so the output signals from the output terminals 96*d* and 96*e* take the same level. When the instant photo film 70 is inserted in between the light projecting section 96*b* and the light receiving section 96*c*, the incident position of the near-infrared rays on the light receiving surface is shifted in correspondence with the position of the side edge of the instant photo film 70 relative to the light receiving surface. Then, the output signal from one of the output terminals 96*d* and 96*e* that is closer to the incident position takes a larger level, whereas the other output signal takes a smaller level. The system controller 106 determines the incident position by the ratio between the two output signals, and calculates the position of the side edge of the instant photo film 70 in the main scan direction.

A pair of developing rollers 100 are disposed behind the photo interruptive sensor 98, for squeezing the solution pod 70*b* of the exposed instant photo film 70 to spread the processing fluid over the exposure area 70*a*. The developing rollers 100 consists of a drive roller 101 coupled to the motor 92 and a driven roller 102 rotated by the rotation of the drive roller 101. The motor 92 is also used for driving the raking mechanism. When the motor 92 is rotated forward, the claw member 81 is activated to push the instant photo film 70. But driving power of the motor 92 in the reverse direction is not transmitted to the raking mechanism.

A lid 104 closing a film exit of the optical line printer is disposed behind the developing roller pair 100. The lid 104 is hinged at its one end, so the advancing instant photo film 70 pushes the lid 104 open.

Figure 15:
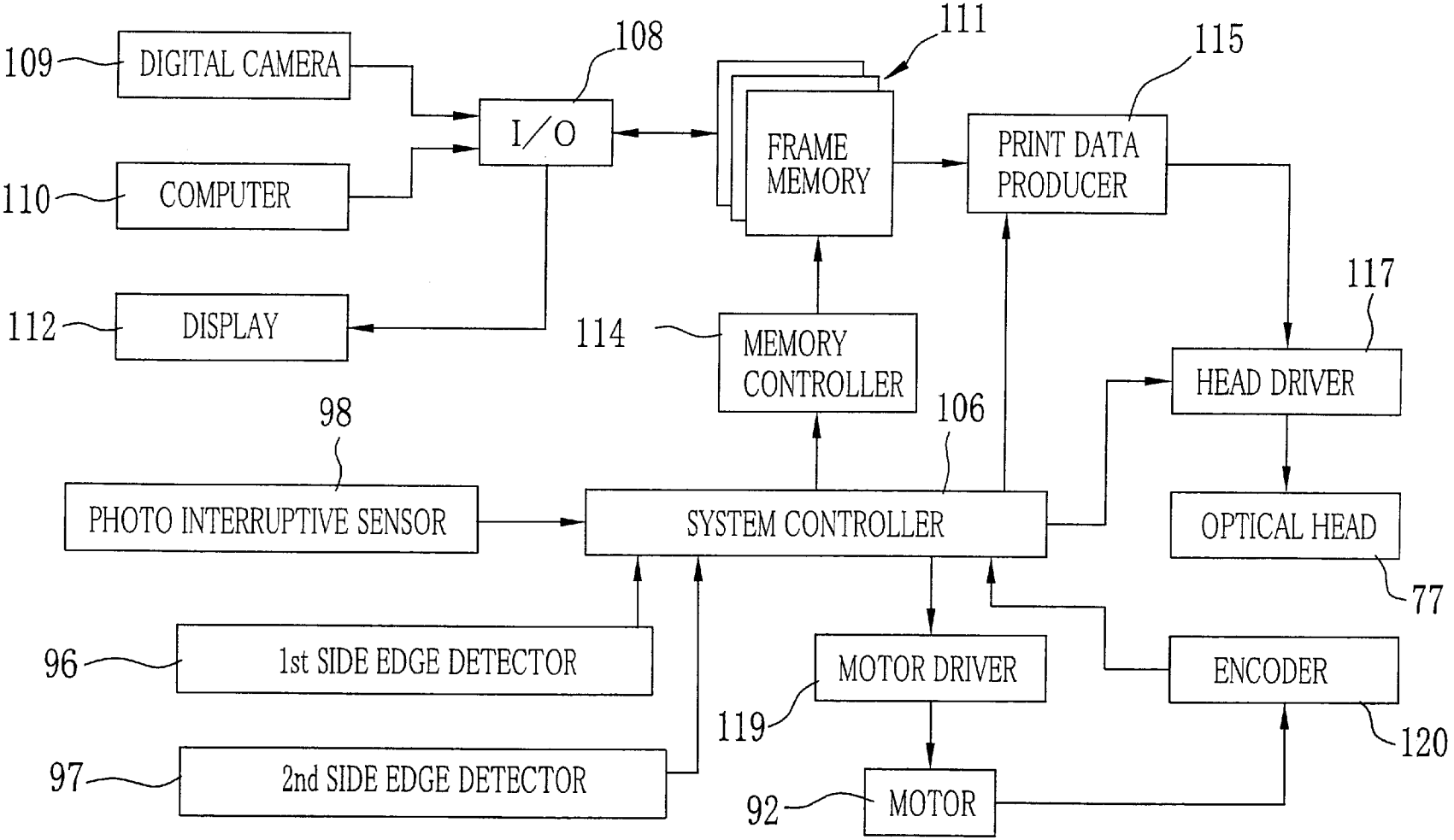
FIG. 15 is a block diagram illustrating a circuitry of the optical line printer.

FIG. 15 shows a circuitry of the optical line printer. The overall operation of the optical line printer is controlled by the system controller 106. The system controller 106 includes a CPU, a program ROM and a work RAM. The system controller 106 controls respective elements of the optical line printer in accordance with control programs stored in the program ROM, while using various data that are written temporarily in the work RAM.

The system controller 106 doubles as a recording position calculator. The edge position data detected through the first and second side edge detectors 96 and 97 are written in the work RAM, and the CPU calculates a position of the exposure area 70*a* of the advancing instant photo film 70 relative to the optical printing head 77 on the basis of the edge position data. Calculation formulas for calculating the relative position of the frame area 6 are stored in the program ROM.

An I/O circuit 108 is connected to not-shown I/O ports through which various kinds of external apparatuses, including a digital camera 109 and a computer 110, can feed image data into the color thermosensitive printer. The I/O circuit 108 separates the entered image data into three-color frame data of red, green and blue, and writes the three-color frame data in frame memories 111 for the three colors. The I/O port also has a video output terminal for outputting NTSC composite signal to a display 112, like TV, for displaying a video image simulating a printed image.

The color frame data is read out from the frame memories 111 and written in a print data producer 115 through a memory controller 114 under the control of the system controller 106. As will be described in detail later, the print data producer 115 produces print data for driving the optical printing head 77 from the color frame data and blank data that does not drive the light emitting elements. Locations of the color frame data and the blank data within the print data are determined in accordance with the relative position of the exposure area 70*a* that is calculated by the CPU, such that the color frame data is allocated only to those light emitting elements whose light beams will fall on the exposure area 70*a*.

The print data produced in the print data producer 115 is applied to a head driver 117, so the head driver 117 drives the light emitting elements in accordance with the print data to expose the instant photo film 70 under the control of the system controller 106.

A motor driver 119 drives the motor 92 under the control of the system controller 106. An encoder 120 is mounted to the motor 92 to detect rotation of the motor 92, and outputs encoder pulses to the system controller 106. Based on the encoder pulses from the encoder 120, the system controller 106 calculates an advanced length of the instant photo film 70.

Figure 16:
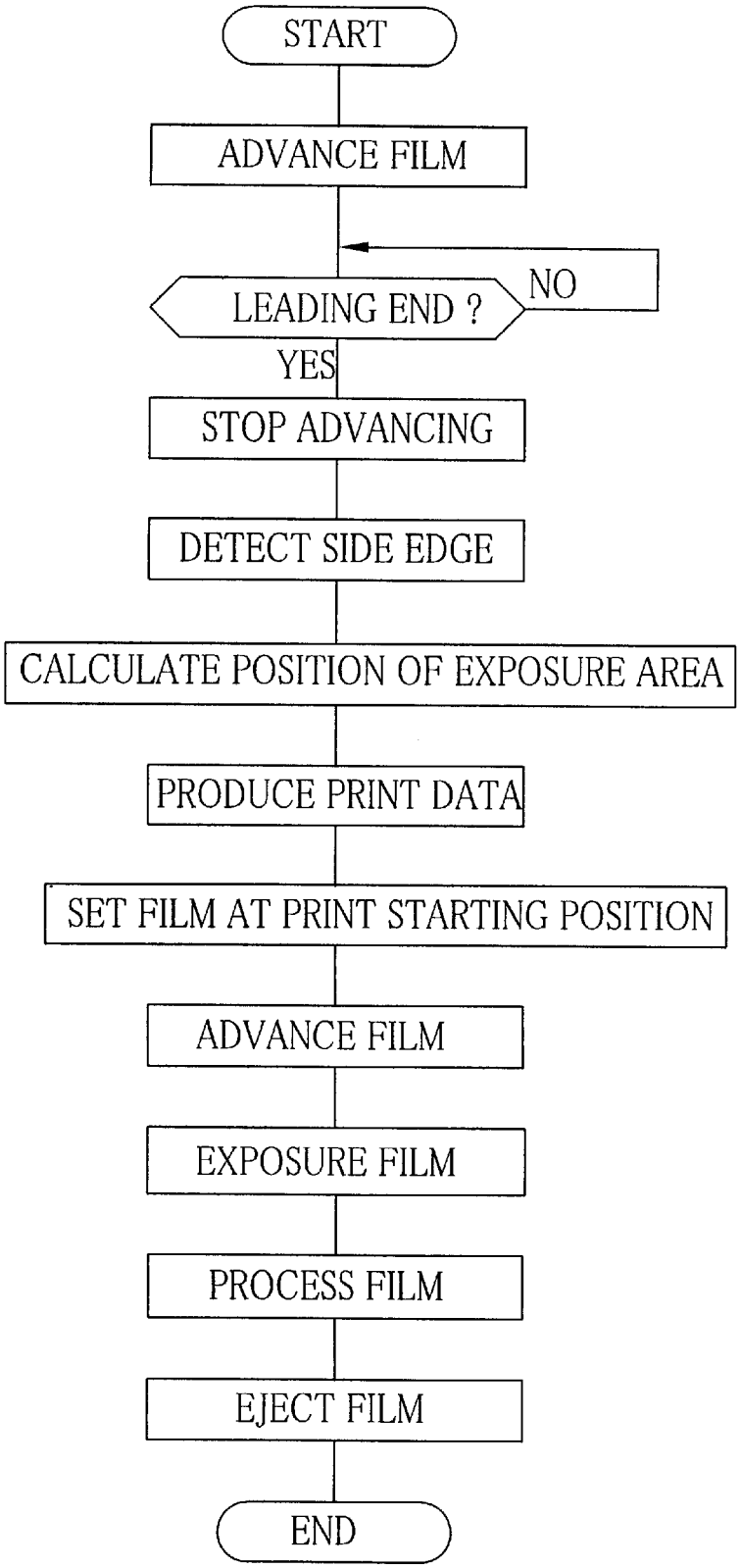
FIG. 16 is a flow chart illustrating the operation of the optical line printer.

Now the operation of the color thermosensitive printer having the above constructions will be described with reference to the flow chart of FIG. 16.

Upon a print starting operation, the system controller 106 drives the motor 92 in the forward direction through the motor driver 119. Then, the claw member 81 is inserted into the cutout 80 to push the topmost instant photo film 70 out of the case 71 through the ejection slot 88. The forward rotation of the motor 92 also causes the capstan rollers 93 of the feed roller pairs 91 and the drive roller 101 of the developing roller pair 100 to rotate in a direction to advance the instant photo film 70 to the film exit.

As the instant photo film 70 moves in the advancing direction, one lateral side of the instant photo film 70 comes into between the light projecting section 96*b* and the light receiving section 96*c* of the first side edge detector 96, and then between the light projecting section and the light receiving section of the second side edge detector 97. When the leading edge of the instant photo film 70 comes into between the light projecting element 98*a* and the light receiving element 98*b*, and thus the photo interruptive sensor 98 outputs a detection signal to the system controller 106. Upon the detection signal from the photo interruptive sensor 98, the system controller 106 stops the motor 92, and activates the side edge detectors 96 and 97 to detect positions of side edge points n' and m' as located at the side edge detectors 96 and 97, as shown in FIG. 11.

Thereafter, the system controller 106 determines incident positions of the near-infrared rays on the light receiving surfaces of the side edge detectors 96 and 97, and then calculates coordinate values (Xm',Ym') and (Xn',Yn') of the side edge points m' and n' on the basis of these incident positions, wherein a leading edge point k' as located at the photo interruptive sensor 98 is used as a reference point of the coordinate whose Y-axis and X-axis correspond to the main scan direction and the sub scan direction respectively. Then, the coordinate values (Xm',Ym') and (Xn',Yn') are memorized in the work RAM.

Based on the coordinate values (Xm',Ym') and (Xn',Yn'), the system controller 106 calculates a relative position of the exposure area 70*a* to the optical printing head 77. Concretely, positions of corner points a', b', c' and d' of the instant photo film 70 and those of corner points e', f', g' and h' of the exposure area 70*a* are determined as coordinate values with respect to the reference point k' (see FIG. 12).

First, an inclination angle θ' of the instant photo film 70 relative to the sub scan direction is calculated based on the coordinate values (Xm',Ym') and (Xn',Yn') in accordance with the same conditions (1) to (5) as described in the first embodiment:

$$Ym'=k1\cdot Xm'+k2 \quad (1)$$

$$Yn'=k1\cdot Xn'+k2 \quad (2)$$

$$k1=(Ym'-Yn')/(Xm'-Xn') \quad (3)$$

$$k2=Ym'-\{Xm'(Ym'-Yn')/(Xm'-Xn')\} \quad (4)$$

$$\theta'=\tan^{-1}\cdot k1 \quad (5)$$

Next, the system controller 106 determines a coordinate value (Xp',Yp') of a cross point p' between an extended line from the side edge of the instant photo film 70 and a line 98*d* that extends in the main scan direction across the reference point k'. Then, the coordinate value (Xa',Ya') of the corner point a' of the instant photo film 70, at which the leading edge meets the side edge of the one lateral side of the instant photo film 70, is calculated by utilizing the inclination angle θ' of the instant photo film 70. Since the coordinate value of the cross point p' with respect to the reference point k' is (0,Yp'), Yp'=k2 according to the condition (1). Also, the length of a line a'–k' that connects the corner point a' to the reference point k' is given as an equation: a'–k'=k2·cos θ'. So the coordinate value (Xa',Ya') of the corner point a' is given as follows:

$$Xa'=a'-k'\cdot\sin\theta'=k2\cdot\sin\theta'\cdot\cos\theta'$$

$$Ya'=a'-k'\cdot\cos\theta'=k2\cdot\cos^2\theta'$$

Since the length Lf of the instant photo film 70 is predetermined, the coordinate value (Xb',Yb') of the corner point b', at which the side edge of the one lateral side meets a trailing edge of the instant photo film 70, is obtained from the coordinate values (Xa',Ya'):

$$Xb'=Xa'+Lf\cdot\cos\theta'$$

$$Yb'=Ya'-Lf\cdot\sin\theta'$$

The coordinate value (Xc',Yc') of the corner point c' at the opposite end of the leading edge from the corner points a' is obtained from the coordinate values (Xa',Ya') and the width Wf of the instant photo film 70:

$$Xc'=Xa'-Wf\cdot\sin\theta'$$

$$Yc'=Ya'-Wf\cdot\cos\theta'$$

In the same way, the coordinate value (Xd,Yd) of the corner point "d" is given as follows:

$$Xd'=Xc'+Lf\cdot\cos\theta'$$

$$Yd'=Yc'-Lf\cdot\sin\theta'$$

It is to be noted that if the instant photo film 70 is inclined in the same direction as the color thermosensitive recording paper 2 shown in FIG. 6, the coordinate values of the corner points a', b', c' and d' of the instant photo film 70 are determined according to the same equations as used for calculating the corner points "a" to "d" of the frame area 6 in the first embodiment. In other words, if the color thermosensitive recording paper 2 is inclined in the same direction as the instant film 70 shown in FIG. 11, the coordinate values of the corner points "a" to "d" of the frame recording area 6 are calculated according to the same equations as used for calculating the corner points a', b', c' and d' of the instant photo film 70.

Then the system controller 106 calculates the coordinate values of the four corner points e' to g' of the exposure area 70*a* based on the coordinate values of the corner points a' to d' of the instant photo film 70 and the sizes Wa, Wb and Wc of the fringing portions around the exposure area 70*a* according to the following equations:

$$We'=Xa'-Wa'\cdot\sin\theta'+Wb'\cdot\cos\theta'$$

$$Ye'=Ya'-Wa'\cdot\cos\theta'-Wb'\cdot\sin\theta'$$

$$Xf'=Xb'-Wa'\cdot\sin\theta'-Wc'\cdot\cos\theta'$$

$$Yf'=Yb'-Wa'\cdot\cos\theta'+Wc'\cdot\sin\theta'$$

$$Xg'=Xc'+Wa'\cdot\sin\theta'+Wb'\cdot\cos\theta'$$

$$Yg'=Yc'+Wa'\cdot\cos\theta'-Wc'\cdot\sin\theta'$$

$$Xh'=Xd'+Wa'\cdot\sin\theta'-Wc'\cdot\cos\theta'$$

$$Yh'=Yd'+Wa'\cdot\cos\theta'+Wc'\cdot\sin\theta'$$

Figure 17:
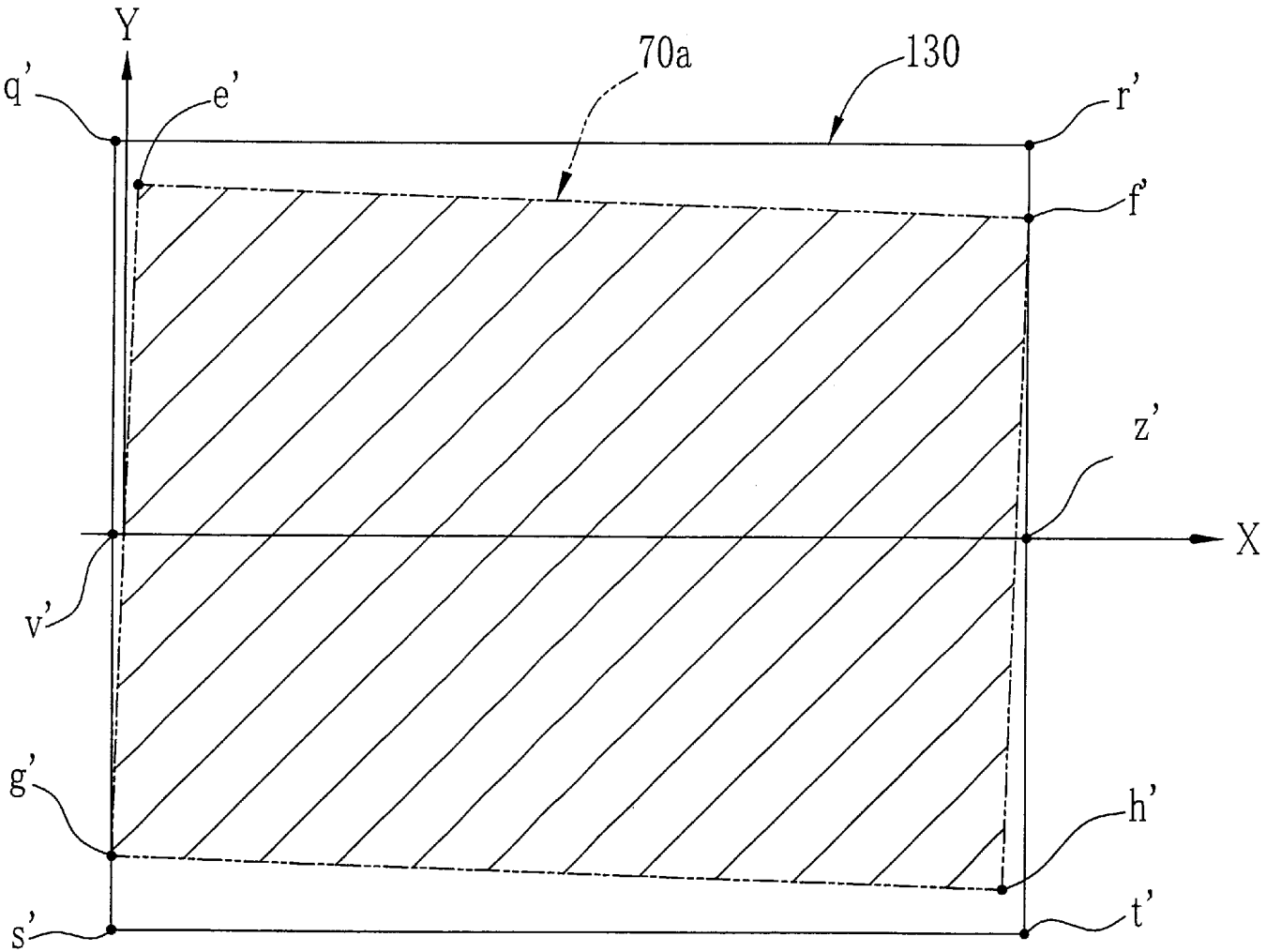
FIG. 17 is an explanatory diagram illustrating a relationship between an exposure area on the instant photo film in which an image is photographed and a scanning area that is defined by a main scanning range and a sub scanning range of an optical head of the optical line printer and corresponds to print data applied to the optical head for printing of that image.

By obtaining the coordinate values of the respective corner points a' to d' of the exposure area 70*a* in this way, the relative position of the exposure area 70*a* to the printing head 77 is determined. Then the system controller 106 controls the memory controller 114 to transfer the respective color frame data from the frame memories 111 to the print data producer 115. From the color frame data, the print data producer 115 produces the print data for the three colors. The print data is defined to cover a rectangular scanning area 130, as shown in FIG. 17. Four corner points of the scanning area 130 are designated by q', r', s' and t'.

Two sides q'–s', r'–t' of the scanning area 130, which extend in the main scan direction (=Y), have the same length Ws as the light slit 77*a* in the main scan direction, and circumscribe the exposure area 70*a*. References v' and z' designate center points of the lines q'–s', r'–t', which correspond to the center point of the light slit 77*a*. Accordingly, lines q'–v', v'–s', r'–z', z'–t' have a length of Ws/2. Also, the line q'–s' corresponds to the center line of the paper path. So it is easy to obtain coordinate values (Xq',Yq'), (Xr',Yr'), (Xs',Ys') and (Xt',Yt') of the corner points q', r', s' and t' of the scanning area 130 with respect to the reference point k' on the basis of the following equations:

$$Xq'=Xs'=Xg'$$

$$Yq'=Yr'=Ws/2$$

$$Xr'=Xt'=Xf'$$

$$Ys'=Yt'=-Ws/2$$

As described above, the print data consists of image data and blank data. The print data producer 115 first defines the size of the scanning area 130, and compares it with the exposure area 70*a* on the basis of the relative position of the exposure area 70*a* to the printing head 77. Then, the print data producer 115 produces the print data from the image data and the blank data. Thereafter, the print data producer 115 rotates the image data in accordance with the inclination angle θ' of the instant photo film 70, and allocates the image data to a location of the print data that corresponds to a location of the exposure area 70*a* within the scanning area 130, as shown by hatching in FIG. 17. To those locations of the print data which correspond to peripheral portions of the scanning area 130 excluded from the exposure area 70*a*, the print data producer 115 allocates the blank data.

After the print data producer 115 produces the print data in this way, the system controller 106 drives the motor 92 in a reverse direction to convey the instant photo film 70 backward through the feed roller pairs 91 till the leading end of the exposure area 70*a* is placed in opposition to the small exposure aperture 75. Since the distance Ls between the feed rollers 91 and the small exposure aperture 75 is less than the length Wb of the pod 70*b*, the leading end of the instant photo film 70 remains being nipped between the feed rollers 91 when the leading end of the exposure area 70*a* is opposed to the small exposure aperture 75.

Then, the motor 92 is driven in the forward direction again, to convey the instant photo film 70 in the film advancing direction, and the printing head 77 is driven in synchronization with the advancement of the instant photo film 70 in accordance with the print data from the print data producer 115. Consequently, only those light emitting elements whose light beams are directed to the exposure area 70*a* through the small exposure aperture 75 are driven with the image data, so the full-color image is photographed on the entire exposure area 70*a* in a proper position even where the advancing instant photo film 70 is inclined to the sub scan direction.

The pod 70*b* is ruptured by the developing rollers 100 and thus the processing fluid flows into the exposure area 70*a*, while the printing head 77 is still exposing a trailing portion of the exposure area 70*a*. However, the printing head 77 is spaced apart from the developing roller pair 100 sufficiently enough for preventing the processing fluid from reaching the presently exposed or unexposed portion of the exposure area 70*a*.

After the entire exposure area 70*a* is exposed by the printing head 77, the instant photo film 70 is ejected through the exit while pushing open the lid 104 from the inside of the optical line printer. The remainder of the processing fluid is absorbed in the trap portion 70*c*.

Although the above embodiment has been described with respect to an optical line printer using an instant photo film, the present invention is applicable to a digital still camera having such an optical line printer incorporated thereinto. Instead of the position sensitive detectors, the side edge of the instant photo film may be detected by means of CCD image sensors. It is also possible to use a single side edge detector and detect a plurality of side edge points of the advancing instant photo film.

The optical printing head 77 may have another configuration. For example, it is possible to optically record a plurality of lines on the instant photo film at a time.

The present invention is applicable not only to color thermosensitive printers or optical line printers, but also to mono-chromatic thermosensitive printers, thermal transfer type printers, dot impact printers, ink-jet printers, laser scanning printers and any other forms of printers insofar as a recording medium is conveyed in the sub scan direction during the printing.

Thus, the present invention is not to be limited to the above embodiments but, on the contrary, various modifications will be possible to those skilled in the art without departing from the sprit and scope of the present invention as indicated by the appended claims.

What is claimed is:

1. A method of printing an image in a designated recording area on a recording medium as the recording medium is advanced in a sub scan direction perpendicular to a main scan direction of a printing head, wherein the printing head may cover a wider main scanning range than the recording area, the method comprising the steps of:

A. detecting the advancing recording medium at least at two points on one side edge thereof to determine positions of the side edge points in the main scan direction;

B. calculating based on the positions of the side edge points a position of the recording area relative to the main scanning range of the printing head;

C. defining a scanning area of the printing head by the main scanning range and a sub scanning range in accordance with the relative position and dimensions of the recording area, such that the scanning area includes the recording area;

D. producing print data in a size corresponding to the scanning area from image data of an image to print, such that the print data includes the image data in a location corresponding to a location of the recording area within the scanning area; and E. driving the printing head with the print data while advancing the recording medium through the sub scanning range.

2. A method as claimed in claim 1, wherein, in step D, blank data that does not cause to record a pixel on the recording medium is allocated to other locations of the print data than the image data.

3. A method as claimed in claim 1, further comprising the step of detecting a leading edge of the recording medium.

4. A method as claimed in claim 3, wherein the relative position of the recording area includes a position in the main scan direction of a leading end corner of the recording area relative to a center point of the main scanning range and an inclination of the recording area to the sub scan direction.

5. A method as claimed in claim 4, wherein, in step D, the image data is rotated within the print data in accordance with the inclination of the recording area.

6. A method as claimed in claim 4, wherein, in step D, the scanning area circumscribes the recording area in the sub scan direction.

7. A method as claimed in claim 4, further comprising the steps of calculating positions in the main and sub scan directions of the side edge points as coordinate values relative to a reference point on the recording medium, the reference point being opposed to a predetermined point on a center line that extends in the sub scan direction across the center point of the main scanning range, when the recording medium reaches a predetermined position in the sub scan direction where at least one of the side edge points is detected, and calculating coordinate values representative of the location of the recording area within the scanning area based on the coordinate values of the side edge points.

8. An apparatus of printing an image in a recording area on a photographic recording medium by a printing head that records pixels linearly on the recording medium along a main scan direction, as the recording medium is advanced in a sub scan direction perpendicular to the main scan direction, wherein the printing head may record pixels across a main scanning range that is wider than a maximum length of the recording area in the main scan direction, the apparatus comprising:

a detection device that receives at least two points corresponding to one side edge of an advancing recording medium to determine positions of the side edge points in the main scan direction;

a calculation device which receives a signal from said detection device and calculates a relative position of the recording area along the main scanning range of the printing head based on the positions of the side edge points, said calculation device defining a scanning area of the printing head by the main scanning range and a sub scanning range, in accordance with the relative position and dimensions of the recording area, such that the scanning area includes the recording area;

a print data producing device which receives data from said calculation device and produces print data in a size corresponding to the scanning area from image data of an image to print, such that the print data includes the image data in a location corresponding to a location of the recording area within the scanning area; and a head driving device which receives data from said print data producing device and drives the printing head with the print data while the recording medium is advanced through the sub scanning range.

9. An apparatus as claimed in claim 8, wherein the print data producing device is adapted to allocate blank data that does not cause a pixel on the recording medium to be recorded at locations of the print data other than the image data.

10. An apparatus as claimed in claim 8, wherein the detection device comprises a photoelectric sensor that extends linearly in the main scan direction in opposition to the one side edge of the advancing recording material.

11. An apparatus as claimed in claim 8, wherein the detection device comprises a photoelectric sensor that is movable in the main scan direction in a range crossing over the one side edge of the advancing recording material.

12. An apparatus as claimed in claim 10 or 11, wherein the detection device sequentially detects the side edge points at predetermined intervals during the advancing movement of the recording medium.

13. An apparatus as claimed in claim 10 or 11, wherein a number of the detection devices are placed at predetermined intervals in the sub scan direction to detect the side edge points concurrently.

14. An apparatus as claimed in claim 8, further comprising a leading edge detection device adapted to detect a leading edge of the recording medium.

15. An apparatus as claimed in claim 14, wherein the calculation device calculates a position in the main scan direction of a leading end corner of the recording area relative to a center point of the main scanning range and an inclination of the recording area to the sub scan direction, and wherein the print data producing device is adapted to rotate the image data within the print data in accordance with the inclination of the recording area.

16. An apparatus as claimed in claim 14, wherein the calculation device calculates positions in the main and sub scan directions of the side edge points as coordinate values relative to a reference point on the recording medium, the reference point being opposed to a predetermined point on a center line that extends in the sub scan direction across the center point of the main scanning range, when the recording medium reaches a predetermined position in the sub scan direction where at least one of the side edge points is detected, and then calculates coordinate values representative of the location of the recording area within the scanning area based on the coordinate values of the side edge points.

17. An apparatus as claimed in claim 8, wherein the recording medium is a photosensitive recording medium, and the printing head is an optical head that may project a linear optical image onto the recording medium across the main scanning range.

18. An apparatus as claimed in claim 8, wherein the printing head is a thermal head that has a heating element array arranged linearly across the main scanning range.

19. An apparatus of printing an image in a recording area on a recording medium by a printing head with an array of heating elements arranged in a main scan direction, as the recording medium is advanced in a sub scan direction perpendicular to the main scan direction, wherein the heating element array has a length that is longer than a maximum length of the recording area in the main scan direction, the apparatus comprising:

a detection device that receives at least two points corresponding to one side edge of an advancing recording medium to determine positions of the side edge points in the main scan direction;

a calculation device which receives a signal from said detection device and calculates a relative position of the recording area to the heating element array based on the positions of the side edge points and is adapted to estimate, based on the calculated relative position of the recording area, which of the heating elements will face the recording area while the recording area is moving past the printing head;

a print data producing device which receives data from said calculation device and produces print data from image data of an image to print and blank data that does not cause the heating element to record a pixel, the print data producing device being adapted to allocate the image data to those heating elements which face the recording area, and allocates the blank data to those heating elements which do not face the recording area; and a head driving device which receives data from said print data producing device and drives the respective heating elements with the print data.

* * * * *